US007991336B2

(12) United States Patent
Takezawa et al.

(10) Patent No.: US 7,991,336 B2
(45) Date of Patent: Aug. 2, 2011

(54) IMAGE FORMING APPARATUS WITH IRRADIATED LIGHT CONTROL BASED ON REFLECTED LIGHT AMOUNTS

(75) Inventors: Satoru Takezawa, Nagareyama (JP); Jun Nakazato, Kashiwa (JP); Hirokazu Kodama, Ryugasaki (JP)

(73) Assignee: Canon Kabushiki Kaisha (JP)

( * ) Notice: Subject to any disclaimer, the term of this patent is extended or adjusted under 35 U.S.C. 154(b) by 71 days.

(21) Appl. No.: 12/534,197

(22) Filed: Aug. 3, 2009

(65) Prior Publication Data

US 2009/0297200 A1 Dec. 3, 2009

Related U.S. Application Data

(63) Continuation of application No. 11/871,630, filed on Oct. 12, 2007, now Pat. No. 7,590,364.

(30) Foreign Application Priority Data

Oct. 12, 2006 (JP) ..... 2006-279155

(51) Int. Cl.
*G03G 15/043* (2006.01)

(52) U.S. Cl. ..... 399/301

(58) Field of Classification Search ..... 399/301; 301/49; 347/236
See application file for complete search history.

(56) References Cited

U.S. PATENT DOCUMENTS

| | | | | |
|---|---|---|---|---|
| 5,245,390 | A | 9/1993 | Ishigaki et al. | |
| 5,860,038 | A * | 1/1999 | Kato et al. | 399/49 |
| 6,285,849 | B1 * | 9/2001 | Shimada et al. | 399/301 |
| 6,611,666 | B2 | 8/2003 | Regelsberger et al. | |
| 7,194,214 | B2 | 3/2007 | Takahashi | |
| 2002/0054204 | A1 | 5/2002 | Ikeda | |
| 2006/0164506 | A1 * | 7/2006 | Kitao | 347/236 |

FOREIGN PATENT DOCUMENTS

| | | | |
|---|---|---|---|
| JP | 6-127039 | A | 5/1994 |
| JP | 2002-055506 | A | 2/2002 |
| JP | 2006-251686 | A | 9/2006 |
| JP | 2006-258906 | A | 9/2006 |

* cited by examiner

*Primary Examiner* — Quana M Grainger
(74) *Attorney, Agent, or Firm* — Rossi, Kimms & McDowell LLP

(57) ABSTRACT

An image forming apparatus includes a pattern forming unit which forms a light amount adjustment pattern on an image carrier belt, a light amount control unit which controls the amount of light irradiating the image carrier belt and pattern, a detection sensor which detects reflected light amounts from the image carrier belt and pattern with respect to the irradiating light amount and stores the detection results in a storage unit, a calculation unit which calculates the correspondence between the irradiating light amount and the reflected light amounts from the image carrier belt and pattern on the basis of the detection results and stores the calculation results in the storage unit, and a light amount decision unit which decides, on the basis of the calculation results, a light amount at which the difference between the reflected light amounts from the image carrier belt and pattern exhibits a value set in advance.

3 Claims, 20 Drawing Sheets

IMAGE FORMING APPARATUS WITH IRRADIATED LIGHT CONTROL BASED ON REFLECTED LIGHT AMOUNTS

This is a continuation of U.S. patent application Ser. No. 11/871,630 filed Oct. 12, 2007, the contents of which is incorporated herein in it's entirety by reference.

BACKGROUND OF THE INVENTION

1. Field of the Invention

The present invention relates to an electrophotographic image forming technique.

2. Description of the Related Art

Some conventional image forming apparatuses such as a printer, copying machine, and facsimile apparatus transfer, onto conveyed paper, a toner image formed on an image carrier (intermediate transfer belt). To correct the position and color misregistration of an image formed on paper, an image forming apparatus of this type forms a reference image (registration correction pattern) on an intermediate transfer belt, detects it, and calculates the positional error amount (registration error amount). The image forming apparatus corrects color misregistration and the position of an image formed on paper based on the calculation result (image position correction).

To detect the registration correction pattern, a predetermined current is supplied to the light-emitting portion of a correction pattern detection sensor so as to obtain a sufficient amount of light to determine the difference between the registration correction pattern and the surface of the intermediate transfer belt serving as an underlayer. This method may suffer a registration correction pattern detection error if the difference in the amount of reflected light between the underlayer and the registration correction pattern becomes small as a result of, for example, contaminating the intermediate transfer belt or the light-receiving portion, or decreasing the amount of light of the light-emitting portion of the correction pattern detection sensor upon a change over time.

Japanese Patent Laid-Open No. 6-127039 discloses a technique of correcting the amount of irradiating light (intensity) of an optical sensor in order to stabilize an amount of reflected light from the underlayer so as to obtain a constant output value for the surface of an intermediate transfer belt before a print job.

Japanese Patent Laid-Open No. 2002-55506 discloses a method of adjusting the amount of light by detecting the density of a correction pattern.

In light amount adjustment disclosed in Japanese Patent Laid-Open No. 6-127039, the amount of light is adjusted to make an output on the belt always constant. When the intermediate transfer belt gets dirty and the amount of light is increased, an output corresponding to the registration correction pattern also rises. No sufficient difference in amount of reflected light can be ensured between the intermediate transfer belt and the registration correction pattern. The registration correction pattern on the intermediate transfer belt cannot be determined at high precision.

In light amount adjustment disclosed in Japanese Patent Laid-Open No. 2002-55506, no amount of reflected light on the intermediate transfer belt is measured. If, for example, the amount of reflected light from the intermediate transfer belt decreases under the influence of a scratch or the like on the intermediate transfer belt, the correction pattern may be erroneously detected.

When the toner density of the correction pattern is optimum and the intermediate transfer belt is free from any factor such as a scratch which decreases the amount of reflected light, a sufficient difference in amount of reflected light can be ensured between the surface of the intermediate transfer belt and the registration correction pattern.

However, an excessive amount of light is projected by adjustment to increase the amount of irradiating light of the light-emitting portion so as to raise the received amount of light from the surface of the intermediate transfer belt to a given value though the registration correction pattern can be accurately determined. This shortens the service life of the light-emitting portion.

Japanese Patent Laid-Open No. 2006-258906 discloses an arrangement to adjust the density of a formed detection pattern in accordance with aged deterioration of the transfer belt so as to make constant the difference between the light reflectances of the detection pattern and underlying belt (a table holds density data to be adopted). However, this reference does not disclose adjustment of the amount of irradiating light of the sensor.

Japanese Patent Laid-Open No. 2006-251686 discloses an arrangement to determine amounts of emitted light separately when detecting color misregistration and the density by a sensor which has one light-emitting portion and two light-receiving portions and detects specular reflection and diffused reflection. According to this arrangement, amounts of emitted light are calculated from a specular reflection output upon detecting the transfer belt and a diffused reflection output upon detecting the pattern so as to increase the difference between reflection by a transfer belt and that by a pattern. However, this reference does not disclose adjustment of the amount of irradiating light of the sensor.

SUMMARY OF THE INVENTION

It is an object of the present invention to provide an image forming technique capable of stably detecting a registration correction pattern even if the toner density of the registration correction pattern or the reflectance of the belt surface changes.

It is another object of the present invention to provide an image forming technique capable of prolonging the service life of the light-emitting portion of a correction pattern detection sensor by setting a minimum light amount value to stably detect a registration correction pattern.

According to one aspect of the present invention, there is provided an image forming apparatus comprising: a pattern forming unit adapted to form a light amount adjustment pattern image on an image carrier; a light amount control unit adapted to control an amount of light irradiating the image carrier and the pattern image; a detection unit adapted to detect reflected light amounts from the image carrier and the pattern image with respect to the irradiating light amount; a calculation unit adapted to calculate a correspondence between the irradiating light amount and the reflected light amounts from the image carrier and the pattern image on the basis of detection results; and a light amount decision unit adapted to decide, on the basis of the correspondence, an irradiating light amount at which a difference between the reflected light amount from the image carrier and the reflected light amount from the pattern image exhibits a value set in advance.

The present invention can stably detect a light amount adjustment pattern even if the toner density of the light amount adjustment pattern or the reflectance of the surface of the image carrier belt changes.

The present invention can prolong the service life of the light-emitting portion of a correction pattern detection sensor by setting a minimum light amount value to stably detect a light amount adjustment pattern.

Further features of the present invention will become apparent from the following description of exemplary embodiments (with reference to the attached drawings).

DESCRIPTION OF THE EMBODIMENTS

Preferred exemplary embodiments of the present invention will now be described in detail with reference to the accompanying drawings. It should be noted that constituent elements set forth in these embodiments are merely examples. The scope of the present invention is not limited by each embodiment below.

First Embodiment

Figure 1:
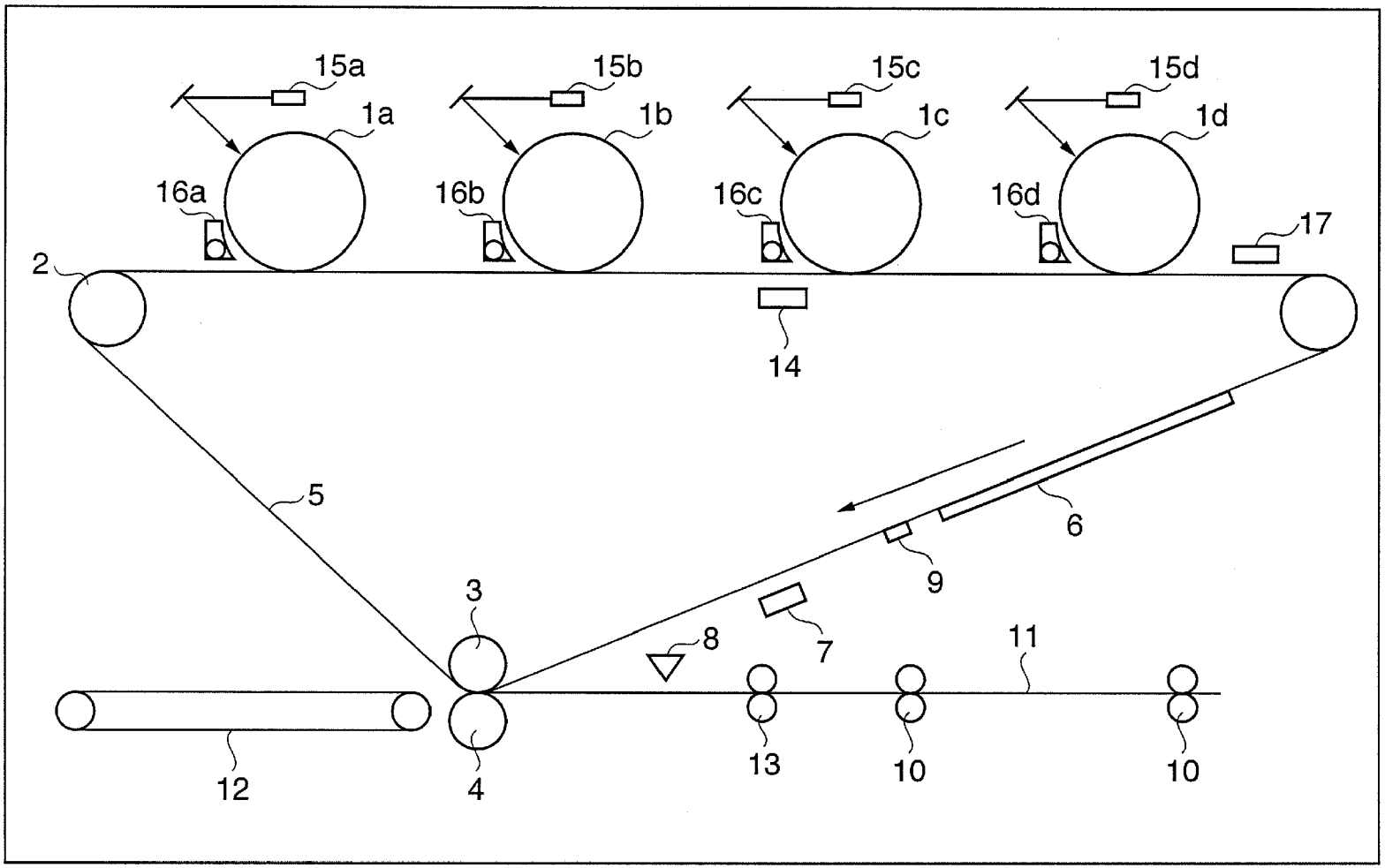
FIG. 1 is a sectional view for explaining the schematic arrangement of an image forming apparatus according to an embodiment.

FIG. 1 is a sectional view for explaining the schematic arrangement of an image forming section in an image forming apparatus according to the embodiment.

(Arrangement of Image Forming Section)

In FIG. 1, laser writing units 15*a*, 15*b*, 15*c*, and 15*d* are arranged in order of yellow (Y), cyan (C), magenta (M), and black (B). Developing units 16*a*, 16*b*, 16*c*, and 16*d* develop latent images formed on photosensitive drums 1*a*, 1*b*, 1*c*, and 1*d* serving as image carriers by the laser writing units 15*a*, 15*b*, 15*c*, and 15*d*. The toner images formed on the photosensitive drums 1*a*, 1*b*, 1*c*, and 1*d* are sequentially transferred over each other on an image carrier belt (to be referred to as an "intermediate transfer belt" hereinafter) 5, forming a color toner image 6.

Color registration, and registration between a sheet and each color toner image are done based on the detection result of a color position adjustment sensor 17.

The color toner image 6 is transferred onto a sheet at the nip (transfer position) between a belt support roller 3 and a transfer roller 4. In the image forming apparatus according to the embodiment, conveyance rollers 10 convey, to registration rollers 13 along a conveyance path 11, a sheet for transferring the color toner image 6. The image forming apparatus controls the conveyance speed of the registration rollers 13 in accordance with the detection timing of a light amount adjustment pattern (to be referred to as a "correction pattern" hereinafter) 9 by a correction pattern detection sensor 7, and the detection timing of the sheet by a sheet detection sensor 8. By controlling the conveyance speed of the registration rollers 13, the image forming apparatus conveys the sheet to the transfer roller 4 and transfers the color toner image 6 to a predetermined position on the sheet. A conveyance belt 12 conveys the sheet bearing the color toner image 6 to a fixing unit (not shown) where the toner image is fixed. Then, the sheet is discharged outside the image forming apparatus.

(Description of Correction Pattern Detection Sensor)

Figure 2A:
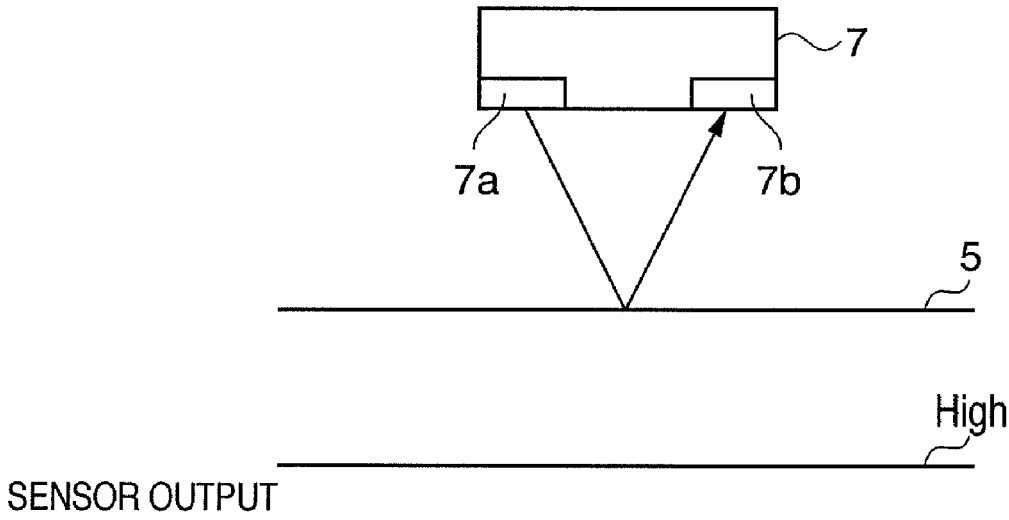
FIGS. 2A and 2B are views for explaining the structure of a correction pattern detection sensor and a correction pattern detection method.
Figure 2B:
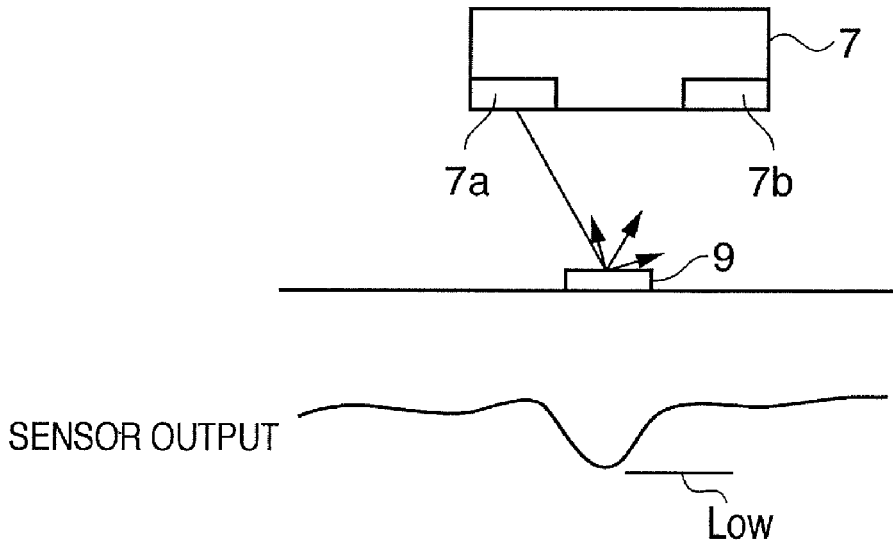

FIGS. 2A and 2B are views for explaining the structure of the correction pattern detection sensor 7 and a correction pattern detection method. As shown in FIG. 2A, the correction pattern detection sensor 7 can be formed from a reflection optical sensor which detects a correction pattern by receiving, by a light-receiving portion 7*b*, the specular reflection component of light emitted from a light-emitting portion 7*a* to the intermediate transfer belt 5. When no correction pattern to be detected exists on the intermediate transfer belt 5 in FIG. 2A, the specular reflection component of irradiating light is sufficient. Thus, the sensor output from the correction pattern detection sensor 7 is high (high output).

If a toner image such as the correction pattern 9 exists on the intermediate transfer belt 5 as shown in FIG. 2B, the diffused reflection component of light increases, the specular reflection component decreases, and the sensor output becomes low (low output). The image forming apparatus according to the embodiment can adjust the amount of irradiating light of the correction pattern detection sensor 7 when detecting a toner image on the intermediate transfer belt 5.

(Arrangement of Control Unit)

Figure 10:
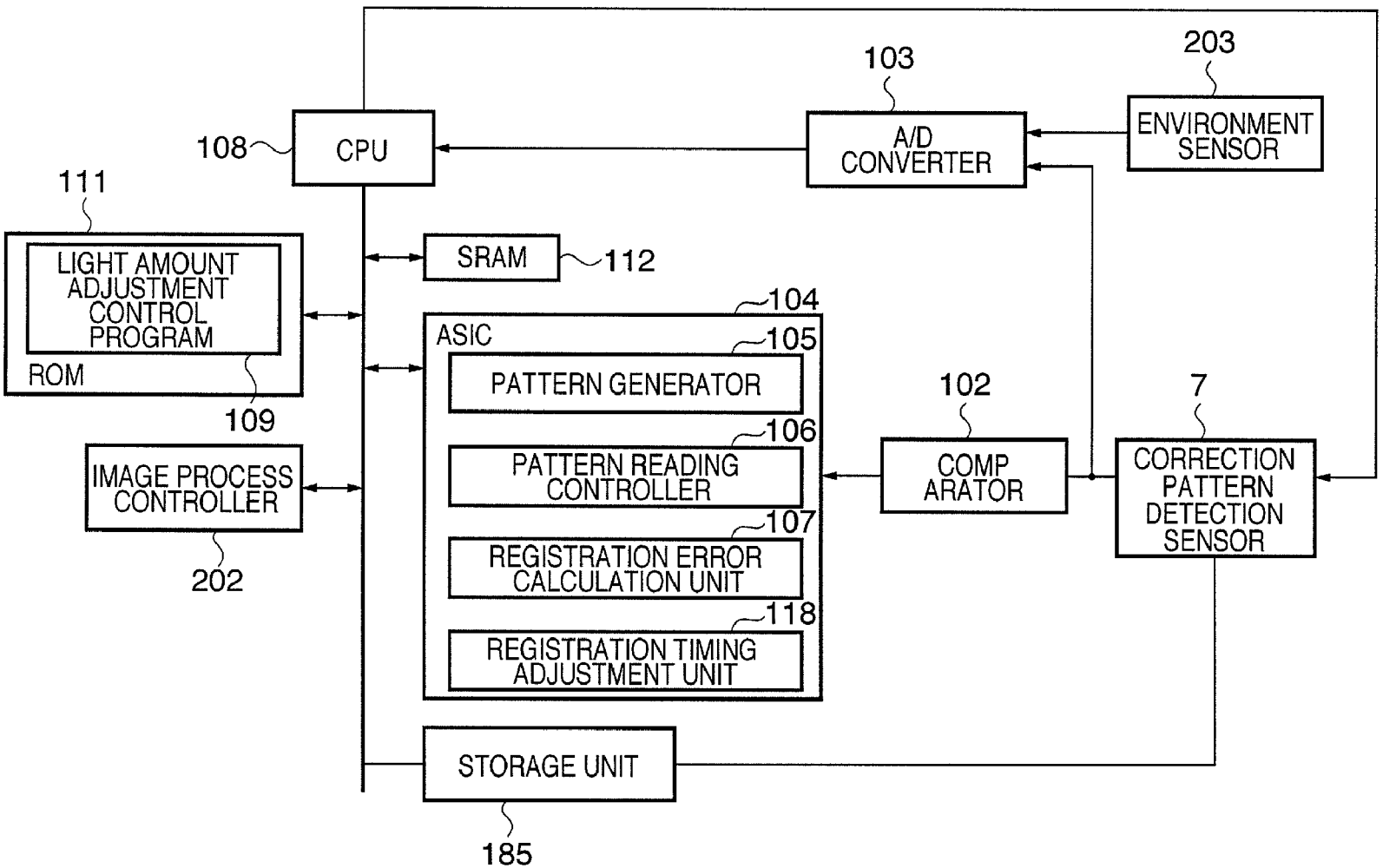
FIG. 10 is a block diagram showing the arrangement of the control unit of the image forming apparatus.

FIG. 10 is a block diagram showing the arrangement of the control unit of the image forming apparatus. The control unit can execute control to correct an image forming position based on the detection result of the correction pattern detection sensor 7 or the like.

In FIG. 10, the correction pattern detection sensor 7 is a reflection optical sensor for detecting a toner image formed on the intermediate transfer belt 5, as described with reference to FIGS. 2A and 2B. The correction pattern detection sensor 7 uses the light-receiving portion 7*b* to receive reflected light from the surface of the intermediate transfer belt 5 or a toner image formed on the surface of the intermediate transfer belt 5. The correction pattern detection sensor 7 converts the amount of received light into a voltage, and outputs the voltage.

A comparator 102 and A/D converter 103 receive a voltage signal output from the correction pattern detection sensor 7. The comparator 102 determines whether the voltage signal output from the correction pattern detection sensor 7 exceeds a predetermined threshold. The comparator 102 outputs the determination result as a binary digital signal. The A/D converter 103 converts the voltage signal (analog output voltage signal) output from the correction pattern detection sensor 7 into a digital signal. The A/D converter 103 outputs the digital signal to a CPU 108 which controls the overall control unit.

An ASIC 104 is a digital integrated circuit including a pattern generator 105, pattern reading controller 106, registration error calculation unit 107, and registration timing adjustment unit 118.

The pattern generator 105 generates image data for a correction pattern to be formed on the intermediate transfer belt 5.

The pattern reading controller 106 can read a signal which is output from the correction pattern detection sensor 7 and binarized by the comparator 102, and can temporarily store the data. The registration error calculation unit 107 calculates the image forming timing error between a sheet and a toner image based on the result of detecting a correction pattern by the correction pattern detection sensor 7. The registration timing adjustment unit 118 controls the sheet conveyance timing based on the image forming timing error calculated by the registration error calculation unit 107.

The CPU 108 is the center of the control unit, and can control various instructions including the execution timing of image forming position correction control. The CPU 108 executes control based on program data stored in a ROM 111. The program data contains a light amount adjustment control program 109 for correcting and controlling an image forming position.

In light amount adjustment control executed by the CPU 108, the CPU 108 can control the light-emitting output (light amount) of the light-emitting portion 7*a* of the correction pattern detection sensor 7. For example, under the control of the CPU 108, the light-emitting output of the light-emitting portion 7*a* of the correction pattern detection sensor 7 can be adjusted to a minimum or maximum light-emitting output or the amount of irradiating light corresponding to the driving current of an LED which forms the light-emitting portion 7*a*.

An SRAM 112 stores data unique to the image forming apparatus, such as an LED driving current value which is determined for the light-emitting portion 7*a* of the correction pattern detection sensor 7 under the control of the light amount adjustment control program 109 executed by the CPU 108.

An image process controller 202 can execute adjustment of the halftone density and the like in various image processes in accordance with instructions from the CPU 108. The image forming apparatus comprises an environment sensor 203 for detecting an external temperature and moisture. The A/D converter 103 converts an output from the environment sensor 203 into a digital signal, which is input to the CPU 108.

The CPU 108 can control the image process controller 202 based on an input from the environment sensor 203. More specifically, the image process controller 202 executes adjustment of the halftone density and the like in various image processes in accordance with instructions from the CPU 108 based on an input from the environment sensor 203.

(Light Amount Adjustment)

Light amount adjustment by the image forming apparatus according to the first embodiment will be explained. The amount of irradiating light of the light-emitting portion is adjusted to ensure a predetermined light amount difference between an amount of reflected light from the surface of the intermediate transfer belt 5 and that from a correction pattern.

Figure 3:
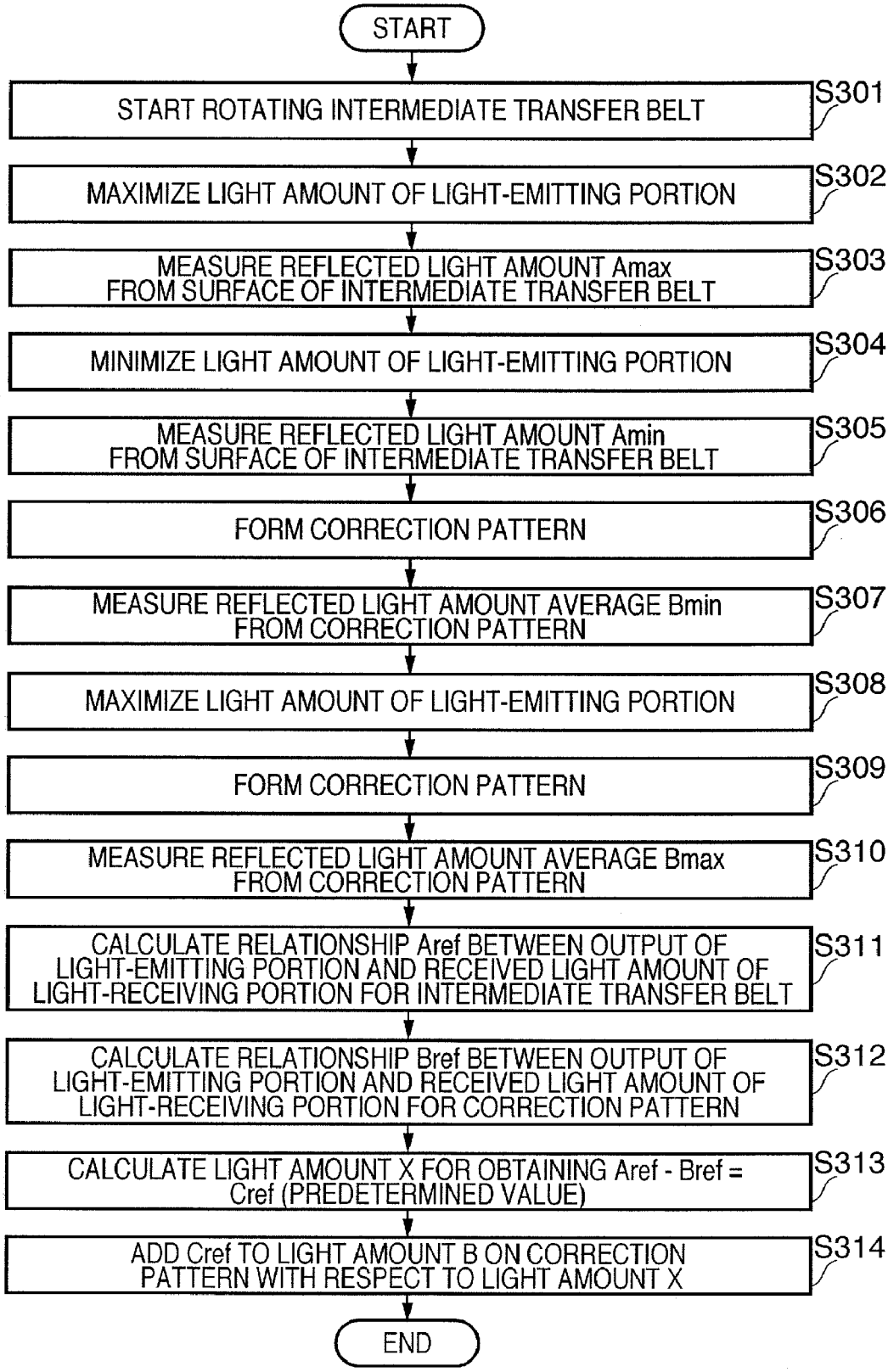
FIG. 3 is a flowchart for explaining the sequence of light amount adjustment according to the first embodiment.

FIG. 3 is a flowchart for explaining the sequence of light amount adjustment in the image forming apparatus according to the first embodiment. The light amount adjustment is executed under the control of the CPU 108.

When the light amount adjustment sequence starts, the CPU 108 rotates the intermediate transfer belt 5 in step S301.

In step S302, the CPU 108 controls the correction pattern detection sensor 7, and the light-emitting portion 7*a* emits the maximum amount of irradiating light onto the surface of the intermediate transfer belt 5.

In step S303, the light-receiving portion 7*b* of the correction pattern detection sensor 7 measures an amount of reflected light Amax for one turn from the surface of the intermediate transfer belt 5 in a predetermined sampling period with respect to the maximum amount of irradiating light emitted in step S302.

In step S304, the CPU 108 controls the correction pattern detection sensor 7, and the light-emitting portion 7*a* emits the minimum amount of irradiating light onto the surface of the intermediate transfer belt 5.

In step S305, the light-receiving portion 7*b* of the correction pattern detection sensor 7 measures an amount of reflected light Amin for one turn from the surface of the intermediate transfer belt 5 in a predetermined sampling period with respect to the minimum amount of irradiating light emitted in step S304.

A process in S311 (to be described later) uses the amount of reflected light Amax to the maximum amount of light and the reflected light amount Amin to the minimum light amount that have been measured in steps S303 and S305.

By these steps, the measurement results of the amounts of reflected light Amin and Amax from the intermediate transfer belt 5 with respect to minimum and maximum amounts of irradiating light can be obtained. The measured data are stored in a storage unit 185 which can be formed from a hard disk or the like.

Then, an amount of reflected light from a correction pattern formed on the intermediate transfer belt 5 is measured. In step S306, a correction pattern based on image data generated by the pattern generator 105 is formed on the intermediate transfer belt 5.

In step S307, the CPU 108 controls the correction pattern detection sensor 7, and the light-emitting portion 7*a* emits the minimum amount of irradiating light to the correction pattern formed in step S306. The light-receiving portion 7*b* receives reflected light from the correction pattern.

Figure 9:
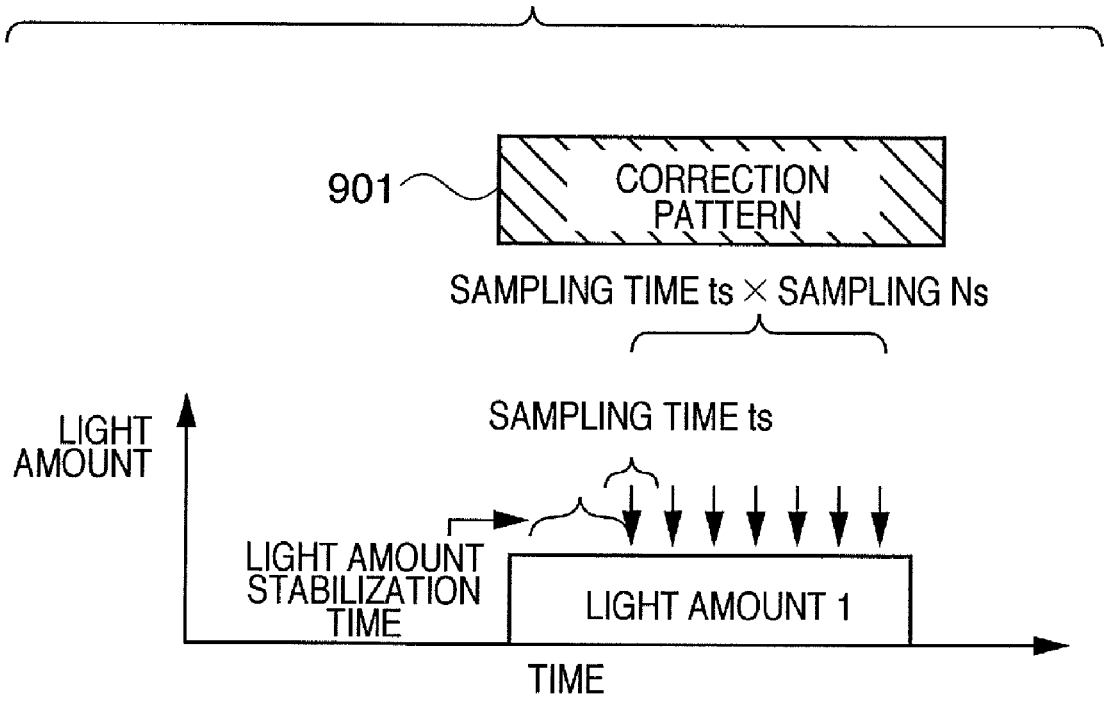
FIG. 9 is a chart for explaining measurement of an amount of reflected light from a correction pattern.

The light-emitting portion 7*a* irradiates a correction pattern 901 with the minimum amount of irradiating light at a sampling count Ns every sampling time ts upon the lapse of the light amount stabilization time after the correction pattern 901 reaches the detection position of the correction pattern detection sensor 7 as shown in FIG. 9. The light-receiving portion 7*b* measures amounts of reflected light from the correction pattern 901. The CPU 108 calculates the average as Bmin at the sampling count Ns based on the measurement results of the light-receiving portion 7*b*.

In step S308, the CPU 108 controls the correction pattern detection sensor 7, and the light-emitting portion 7*a* emits the maximum amount of irradiating light.

In step S309, a correction pattern based on image data generated by the pattern generator 105 is formed on the intermediate transfer belt 5. The correction pattern formed in step S306 is also available.

In step S310, the CPU 108 controls the correction pattern detection sensor 7, and the light-emitting portion 7*a* irradiates the correction pattern formed in step S309 with the maximum amount of irradiating light. The light-receiving portion 7*b* receives reflected light from the correction pattern.

The light-emitting portion 7*a* irradiates the correction pattern 901 with the maximum amount of irradiating light at the sampling count Ns every sampling time ts upon the lapse of the light amount stabilization time after the correction pattern reaches the detection position of the correction pattern detection sensor 7. The light-receiving portion 7*b* measures amounts of reflected light from the correction pattern 901. The CPU 108 calculates the average as Bmax at the sampling count Ns based on the measurement results of the light-receiving portion 7*b*.

Steps S306 to S310 provide the measurement results Bmin and Bmax of average amounts of reflected light from the correction pattern with respect to minimum and maximum irradiating amounts of light. The storage unit 185 stores the measured data.

In S311, the CPU 108 calculates equation (1) of a linear interpolation relationship Aref between the output (irradiating light amount) of the light-emitting portion and the received amount of light of the light-receiving portion based on the measurement results Amin and Amax of the intermediate transfer belt 5 and a maximum amount of light Xmax and minimum amount of light Xmin of the light-emitting portion 7*a*:

$$Aref=(Amax-Amin)/(Xmax-Xmin) \quad (1)$$

In S312, the CPU 108 calculates equation (2) of a linear interpolation relationship Bref between the output (irradiating light amount) of the light-emitting portion and the received amount of light of the light-receiving portion based on the measurement results Bmin and Bmax of the correction pattern and the maximum amount of light Xmax and minimum amount of light Xmin of the light-emitting portion 7*a*:

$$Bref=(Bmax-Bmin)/(Xmax-Xmin) \quad (2)$$

Figure 7:
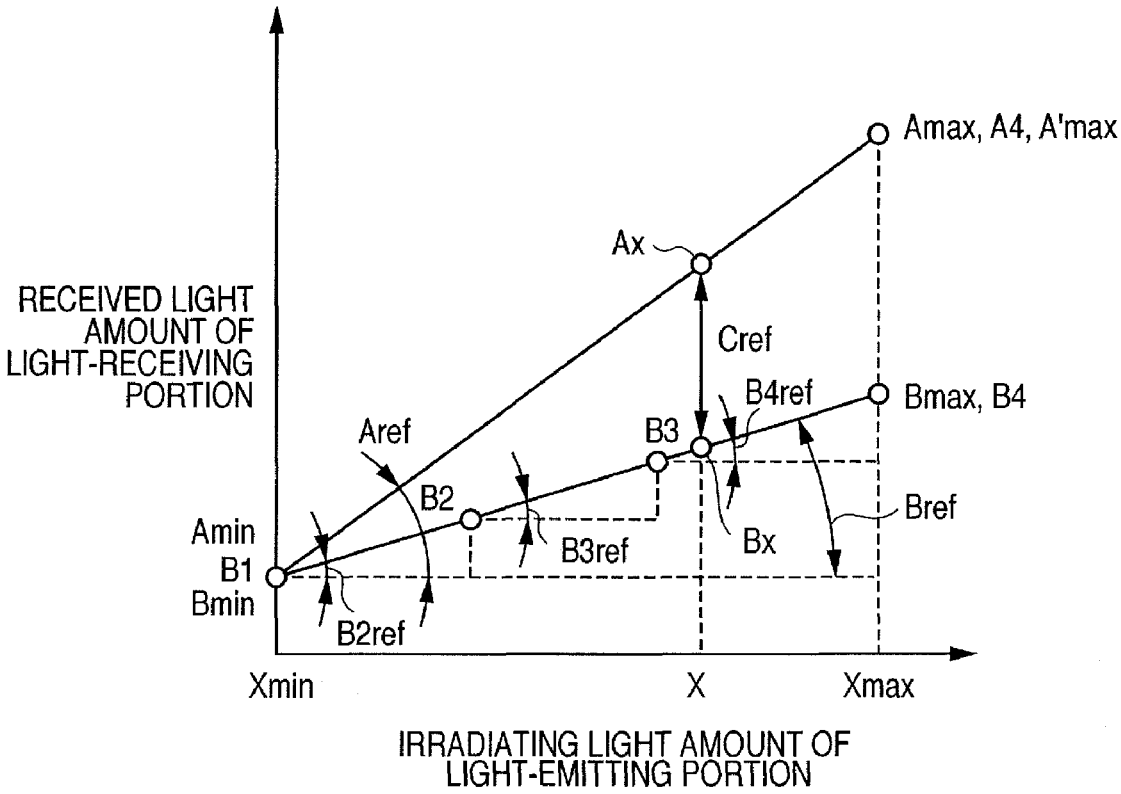
FIG. 7 is a graph showing the linear interpolation relationship between the output of a light-emitting portion and the received light amount of a light-receiving portion.

The CPU 108 can obtain linear interpolation relationships shown in FIG. 7 between the output (irradiating light amount) of the light-emitting portion and the received amount of light of the light-receiving portion based on the measurement results Amin and Amax of the intermediate transfer belt 5 and the measurement results Bmin and Bmax of the correction pattern. The storage unit 185 stores the linear interpolation relationships.

In step S313, the CPU 108 calculates an amount of light X for obtaining Aref−Bref=light amount difference Cref (predetermined value). The difference in amount of light Cref (predetermined value) is arbitrarily settable depending on the material of the intermediate transfer belt or the type of toner for use. The difference in amount of light Cref (predetermined value) can be set individually. Alternatively, the intermediate value between Aref and Bref is available as Cref based on the calculation results of equations (1) and (2). The difference in amount of light Cref (predetermined value) is stored in the storage unit 185 and is changeable by an input unit (not shown).

In step S314, the CPU 108 obtains a received amount of light Bx of the light-receiving portion 7*b* corresponding to the amount of light X calculated in step S313 based on the linear interpolation relationship Bref (FIG. 7) between the output (amount of irradiating light) of the light-emitting portion and the amount of received light of the light-receiving portion for the correction pattern. By adding Cref (predetermined value) to the amount of received light Bx, the CPU 108 calculates Ax (=Cref+Bx) as an amount of reflected light (amount of light of the light-receiving portion) for identifying the intermediate transfer belt 5.

The first embodiment can set a minimum light amount value for stably detecting a correction pattern.

A correction pattern can be stably detected by setting a minimum light amount value while ensuring a predetermined difference in amount of light between an amount of reflected light from the intermediate transfer belt and that from the correction pattern in order to detect the correction pattern. In other words, even if the toner density of a correction pattern or the reflectance of the transfer belt surface changes, the correction pattern can be stably detected.

The first embodiment can prolong the service life of the light-emitting portion of the correction pattern detection sensor by setting a minimum light amount value while ensuring a predetermined difference in amount of light between an amount of reflected light from the intermediate transfer belt and that from a correction pattern.

Second Embodiment

Figure 4:
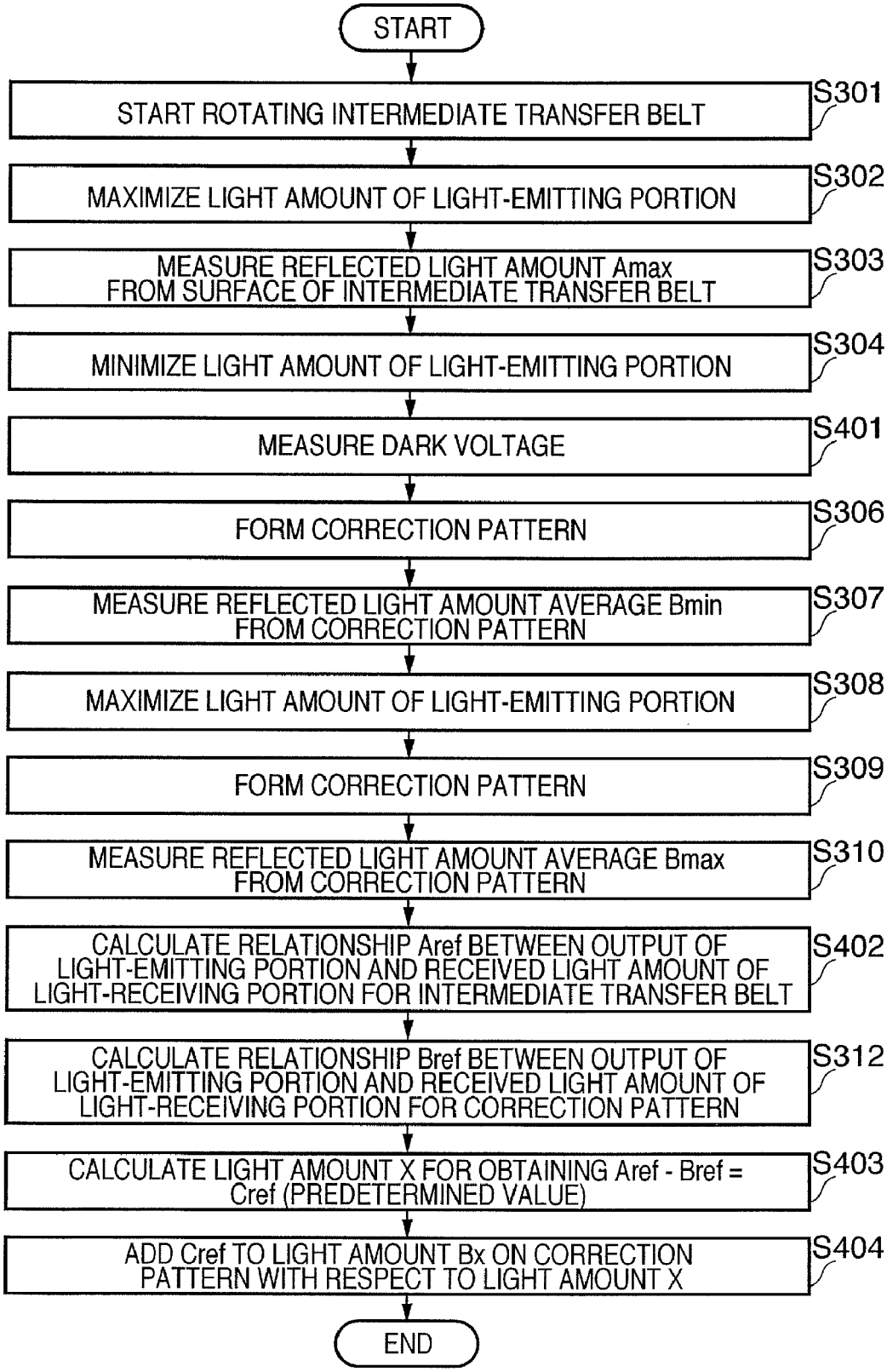
FIG. 4 is a flowchart for explaining the sequence of light amount adjustment according to the second embodiment.

Adjustment of amount of light by an image forming apparatus according to the second embodiment will be explained. FIG. 4 is a flowchart for explaining the sequence of adjustment of amount of light in the image forming apparatus according to the second embodiment. The adjustment of amount of light is executed under the control of a CPU 108. The same step numbers as those in the adjustment of amount of light (FIG. 3) according to the first embodiment denote the same processes, and a description thereof will not be repeated. Steps S301 to S304 and S306 to S310 are the same processes as those in the adjustment of amount of light according to the first embodiment.

In step S401, the CPU 108 measures the dark voltage of a light-receiving portion 7*b* of a correction pattern detection sensor 7, and outputs the measurement result as an amount of reflected light from the surface of an intermediate transfer belt 5 with respect to the minimum amount of irradiating light.

The CPU 108 controls a light-emitting portion 7*a* of the correction pattern detection sensor 7 to set the light amount value to 0. Then, the amount of reflected light from the surface of the intermediate transfer belt 5 becomes 0, or the dark voltage becomes almost constant. An output from the light-receiving portion 7*b* when the light-emitting portion 7*a* is OFF is set, and this value is defined as Amin. In this case, Amin corresponds to an intercept along the ordinate axis representing the amount of light of the light-receiving portion in FIG. 7.

In S402, the CPU 108 calculates the linear interpolation relationship Aref between the output (irradiating light amount) of the light-emitting portion and the amount of received light of the light-receiving portion based on the measurement result Amax of the intermediate transfer belt 5, the set value Amin, and the maximum amount of light Xmax and minimum amount of light Xmin of the light-emitting portion 7*a*.

Letting the minimum amount of light Xmin=0, Aref can be given by $$Aref=(Amax-Amin)/(Xmax) \quad (3)$$

Calculation of Bref in step S312 is the same as the light amount adjustment process (FIG. 3) using equation (2) in the first embodiment.

In step S403, the CPU 108 calculates the amount of light X for obtaining Aref−Bref=difference in amount of light Cref (predetermined value) based on Aref calculated by equation (3). The difference in amount of light Cref (predetermined value) is arbitrarily settable depending on the material of the intermediate transfer belt or the type of toner for use. The difference in amount of light Cref (predetermined value) can be set individually. Alternatively, the intermediate value between Aref and Bref is available as Cref based on the calculation results of equations (2) and (3).

In step S404, the CPU 108 obtains the amount of received light Bx of the light-receiving portion 7*b* corresponding to the amount of light X calculated in step S403 based on the linear interpolation relationship Bref (FIG. 7) between the output (amount of irradiating light) of the light-emitting portion and the amount of received light of the light-receiving portion for the correction pattern. By adding Cref (predetermined value) to the amount of received light Bx, the CPU 108 calculates Ax (=Cref+Bx) as an amount of reflected light (amount of light of the light-receiving portion) for identifying the intermediate transfer belt 5.

The second embodiment can shorten the light amount adjustment time by using the dark voltage measurement result without measuring the amount of reflected light Amin from the surface of the intermediate transfer belt 5 in the light amount adjustment process.

Third Embodiment

Figure 5:
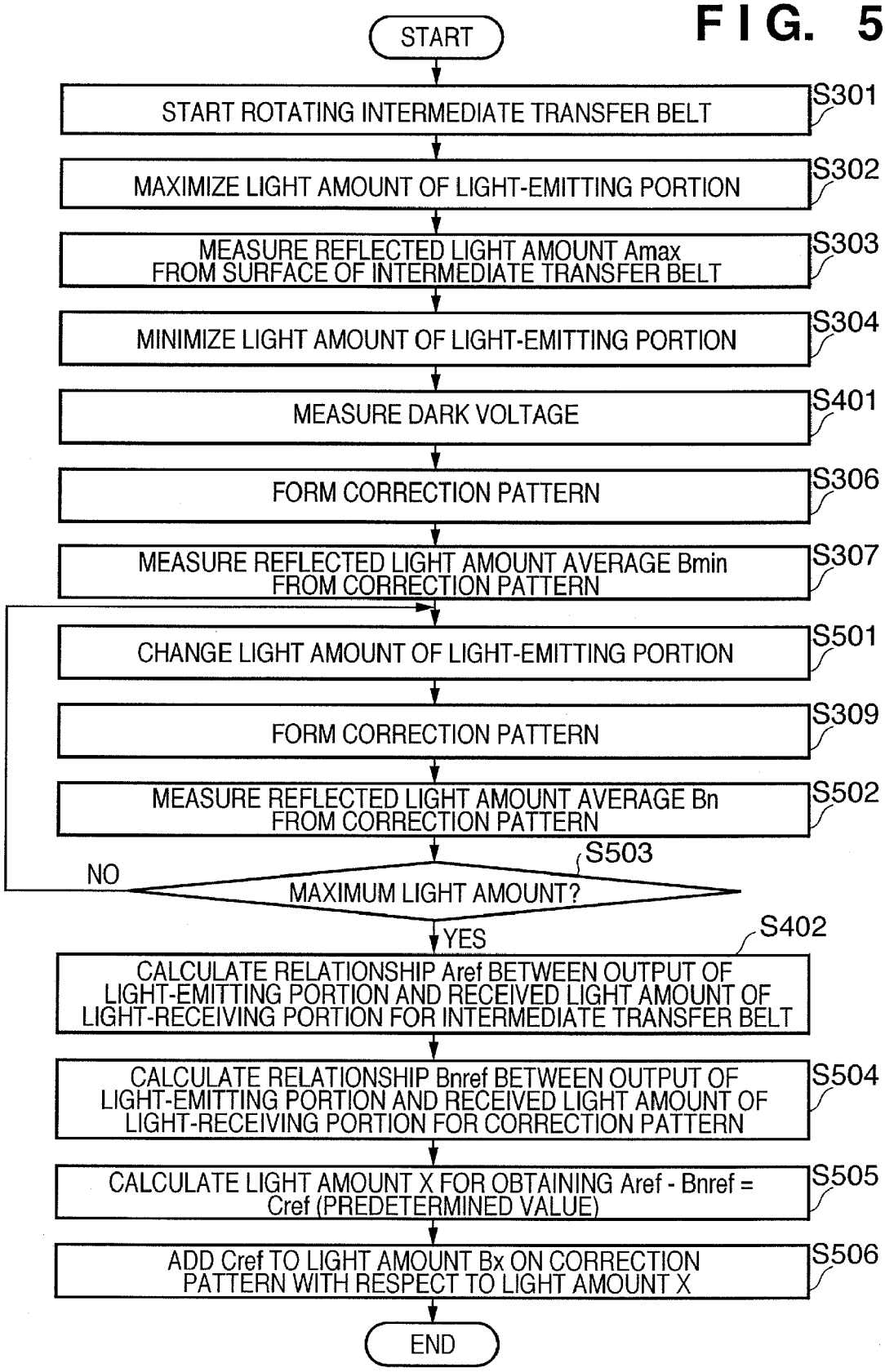
FIG. 5 is a flowchart for explaining the sequence of light amount adjustment according to the third embodiment.

Adjustment of amount of light by an image forming apparatus according to the third embodiment will be explained. FIG. 5 is a flowchart for explaining the sequence of adjustment of amount of light in the image forming apparatus according to the third embodiment. The adjustment of amount of light is executed under the control of a CPU 108. The same step numbers as those in the adjustments of amount of light (FIGS. 3 and 4) according to the first and second embodiments denote the same processes, and a description thereof will not be repeated.

Steps S301 to S304, S306, and S307 are the same processes as those in the adjustment of amount of light according to the first embodiment. S401 is the same process as that in the adjustment of amount of light according to the second embodiment.

In step S501, the CPU 108 controls a correction pattern detection sensor 7, and a light-emitting portion 7*a* changes the amount of irradiating light.

In step S309, a correction pattern is formed similarly to the process in the first embodiment. A correction pattern based on image data generated by a pattern generator 105 is formed on an intermediate transfer belt 5.

In step S502, the light-emitting portion 7*a* irradiates the correction pattern formed in step S309 with the amount of irradiating light changed in step S501. A light-receiving portion 7*b* receives reflected light from the correction pattern.

Figure 8A:
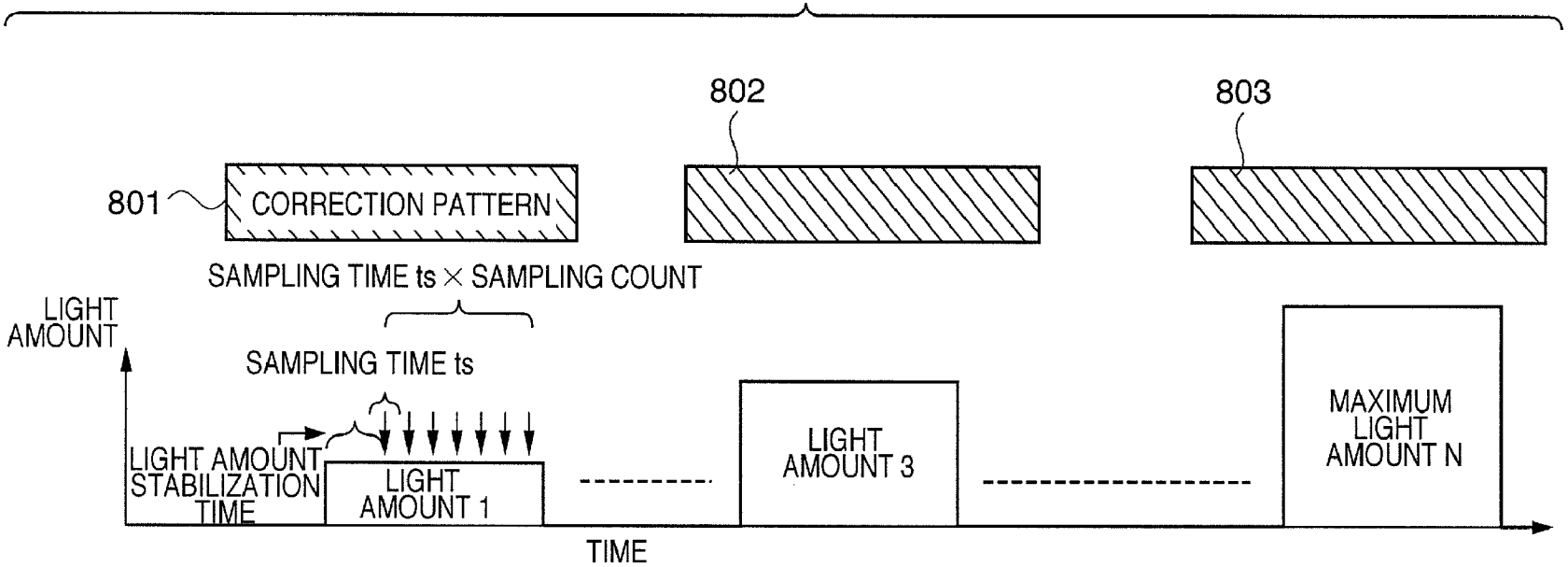
FIG. 8A is a chart schematically showing the relationship between the correction pattern irradiation timing and the amount of light.

FIG. 8A is a chart schematically showing the relationship between the correction pattern irradiation timing and the amount of light. The light-emitting portion 7*a* irradiates a correction pattern 801 with the changed amount of irradiating light at the sampling count Ns every sampling time ts upon the lapse of the light amount stabilization time after the correction pattern reaches the detection position of the correction pattern detection sensor 7 (FIG. 8A). The light-receiving portion 7*b* measures amounts of reflected light from the correction pattern 801. The CPU 108 calculates the average as Bn at the sampling count Ns based on the measurement results of the light-receiving portion 7*b*.

In step S503, the CPU 108 determines whether the amount of light of the light-emitting portion 7*a* has reached a maximum. If the amount of light of the light-emitting portion 7*a* has not reached a maximum (NO in S503), the process returns to step S501 to repeat the same processes for correction patterns 802 and 803. As shown in FIG. 8A, the amount of light of the light-emitting portion 7*a* is increased sequentially to light amount 1 . . . <light amount 3 . . . <maximum light amount Nmax. The light-receiving portion 7*b* measures an average amount of reflected light Bn corresponding to each amount of light. For example, a storage unit 185 stores the measured data.

If the CPU 108 determines in step S503 that the amount of light of the light-emitting portion 7*a* has reached a maximum (YES in S503), the process advances to step S402.

At this stage, measurement of the average amount of reflected light Bn (n=1 (light amount 1), 2 (light amount 2), 3 (light amount 3), . . . , N (maximum light amount)) corresponding to each amount of light is completed.

In step S402, the CPU 108 calculates the linear interpolation relationship Aref between the output (irradiating light amount) of the light-emitting portion and the amount of received light of the light-receiving portion from equation (3) described in the second embodiment.

In S504, the CPU 108 calculates equation (4) of a linear interpolation relationship Bnref between the output (amount of irradiating light) of the light-emitting portion and the amount of received light of the light-receiving portion based on the measurement results Bn−1 and Bn of the correction pattern and the corresponding amounts of light Xn−1 and Xn of the light-emitting portion 7*a:*

$$Bn\mathrm{ref}=(Bn-Bn-1)/(Xn-Xn-1) \tag{4}$$

($n$=1 to $N$max)

In FIG. 7, B2ref, B3ref, and B4ref are calculated for n=2, 3, and 4 in equation (4).

In S505, the CPU 108 calculates the amount of light X for obtaining Aref−Bnref=difference in amount of light Cref (predetermined value) based on the calculation result in S504.

The difference in amount of light Cref (predetermined value) is arbitrarily settable in accordance with the material of the intermediate transfer belt or the type of toner for use. The difference in amount of light Cref (predetermined value) can be set individually. Alternatively, the intermediate value between Aref and Bnref is available as Cref based on the calculation results of equations (3) and (4).

In S506, the CPU 108 obtains the amount of received light Bx of the light-receiving portion 7*b* corresponding to the amount of light X calculated in step S505 based on the linear interpolation relationship Bnref between the output (amount of irradiating light) of the light-emitting portion and the amount of received light of the light-receiving portion for the correction pattern. By adding Cref (predetermined value) to the amount of received light Bx, the CPU 108 calculates Ax (=Cref+Bx) as an amount of reflected light (amount of light of the light-receiving portion) for identifying the intermediate transfer belt 5.

The third embodiment can obtain the relationship between the amounts of light of the light-emitting portion and light-receiving portion at high precision by interpolating and using a plurality of measurement results corresponding to changed amounts of light of the light-emitting portion. As a result, the third embodiment can reduce correction pattern detection errors.

Fourth Embodiment

Figure 6:
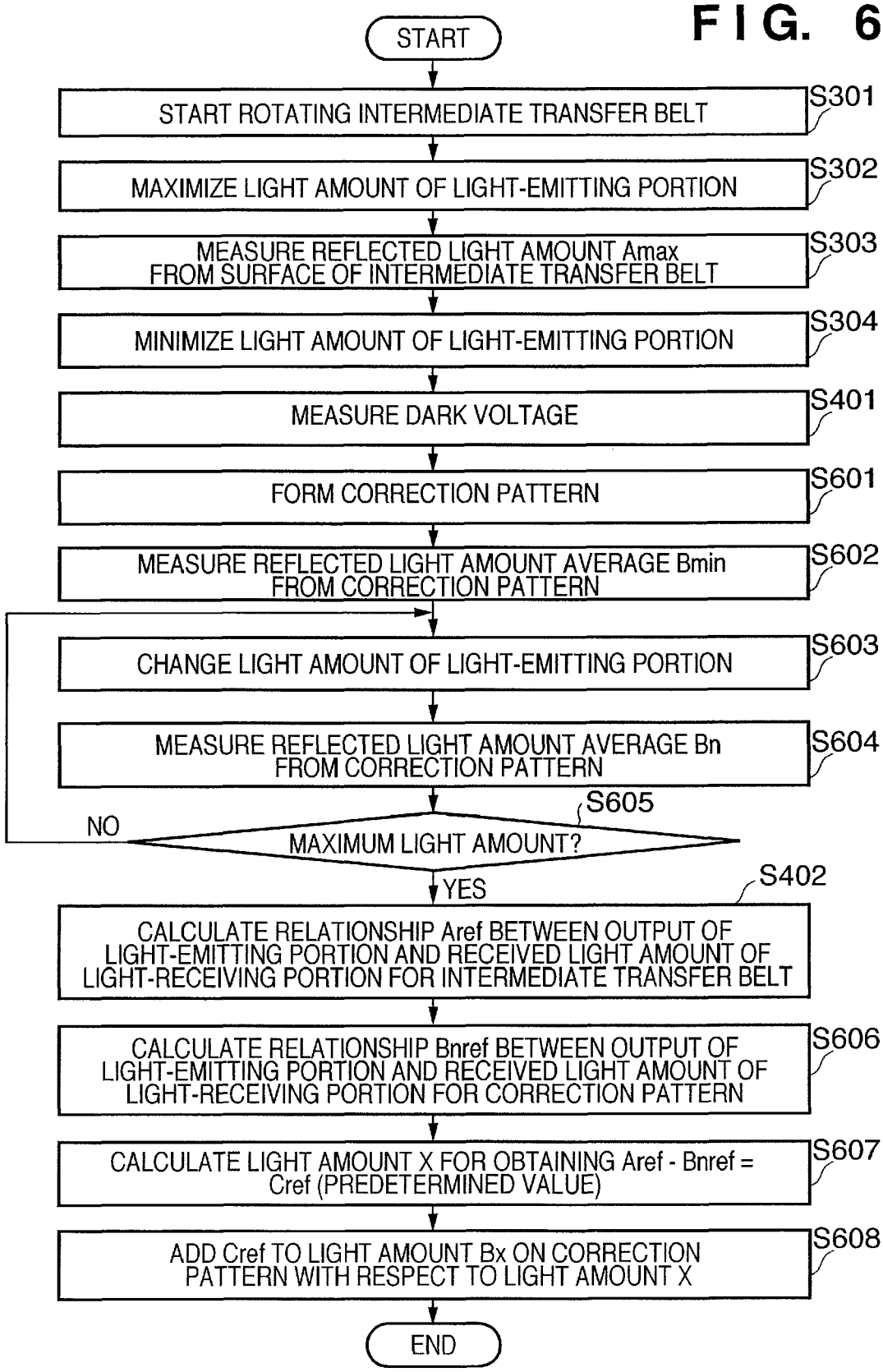
FIG. 6 is a flowchart for explaining the sequence of light amount adjustment according to the fourth embodiment.

Adjustment of amount of light by an image forming apparatus according to the fourth embodiment will be explained. FIG. 6 is a flowchart for explaining the sequence of adjustment of amount of light in the image forming apparatus according to the fourth embodiment. The adjustment of amount of light is executed under the control of a CPU 108. The same step numbers as those in the adjustments of amount of light (FIGS. 3 and 4) according to the first to third embodiments denote the same processes, and a description thereof will not be repeated.

Steps S301 to S304 are the same processes as those in the adjustment of amount of light according to the first embodiment. S401 is the same process as that in the adjustment of amount of light according to the second embodiment.

Figure 8B:
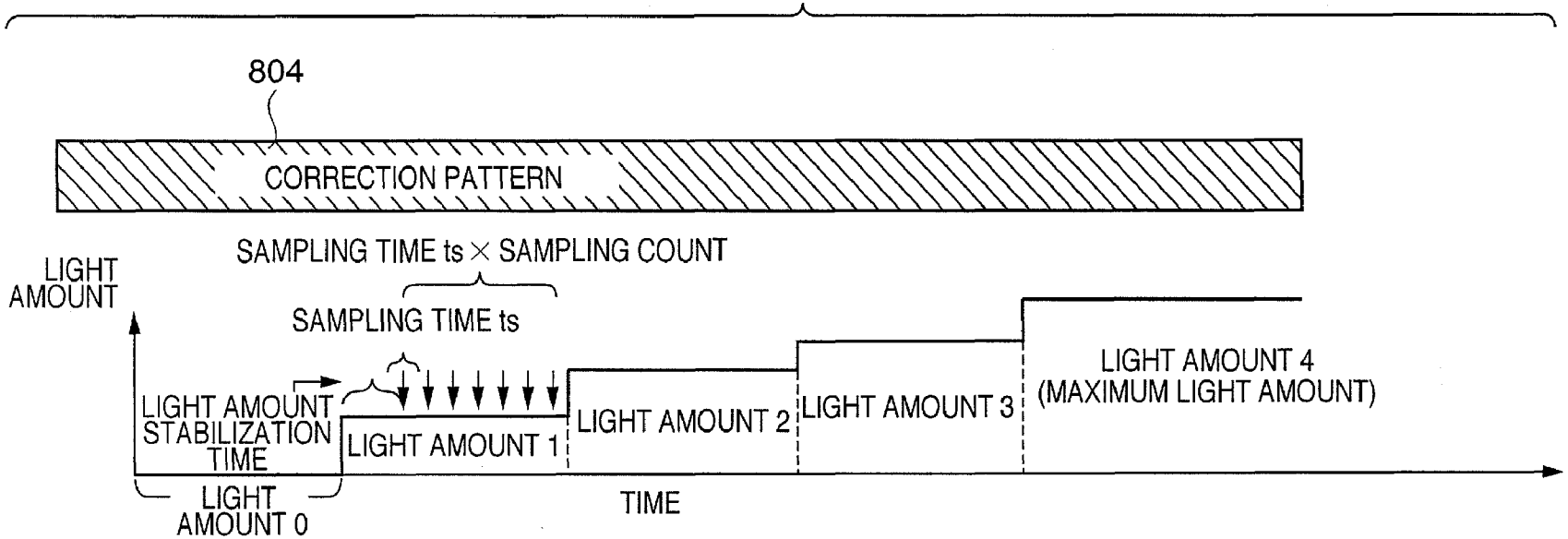
FIG. 8B is a chart schematically showing the relationship between the correction pattern irradiation timing and the amount of light.

In step S601, a correction pattern based on image data generated by a pattern generator 105 is formed on an intermediate transfer belt 5. FIG. 8B is a chart schematically showing the relationship between the correction pattern irradiation timing and the amount of light. As shown in FIG. 8B, the amount of irradiating light is changed from light amount 1 to light amount 4 for one correction pattern 804 to measure amounts of received light of a light-receiving portion 7*b*. Assume that the correction pattern 804 has a length enough to measure a plurality of amounts of light.

The pattern generator 105 can determine the size of the correction pattern based on the light amount stabilization time of a light-emitting portion 7*a*, the sampling time of the light-receiving portion 7*b*, the sampling count, and the count at which the amount of irradiating light changes (from light amount 1 to light amount 4 in FIG. 8B).

In step S602, the CPU 108 controls a correction pattern detection sensor 7, and the light-emitting portion 7*a* irradiates the correction pattern 804 formed in step S601 with irradiating light of light amount 1. The light-receiving portion 7*b* receives reflected light from the correction pattern. As an example of the measurement condition, the light amount stabilization time upon increasing the irradiating light amount to light amount 1 is set to 20 ms. The average of measurement results is defined as Bmin at the sampling time ts=10 ms and the sampling count=7.

In step S603, the CPU 108 controls the correction pattern detection sensor 7 to increase the amount of irradiating light of the light-emitting portion 7*a* by a predetermined value (for example, the amount of irradiating light increases to light amount 2 in FIG. 8B).

In step S604, the light-emitting portion 7*a* irradiates the correction pattern 804 with the changed amount of irradiating light at the sampling count Ns every sampling time ts upon the lapse of the light amount stabilization time (FIG. 8B). The light-receiving portion 7*b* measures amounts of reflected light from the correction pattern 804. The CPU 108 calculates the average as Bn at the sampling count Ns based on the measurement results of the light-receiving portion 7*b*.

In step S605, the CPU 108 determines whether the amount of light of the light-emitting portion 7*a* has reached a maximum. If the amount of light of the light-emitting portion 7*a* has not reached a maximum (NO in S605), the process returns to step S603 to repeat the same processes. As shown in FIG. 8B, the amount of light of the light-emitting portion 7*a* is increased to light amount 3 and light amount 4. The light-receiving portion 7*b* measures Bn corresponding to each amount of light until the amount of light reaches a maximum (light amount 4 in FIG. 8B).

If the CPU 108 determines in step S605 that the amount of light of the light-emitting portion 7*a* has reached a maximum (YES in S605), the process advances to step S402.

At this stage, measurement of Bn (n=1 (light amount 1), 2 (light amount 2), 3 (light amount 3), and 4 (light amount 4: maximum light amount)) corresponding to each amount of light is completed. A storage unit 185 stores the measured data.

In step S402, the CPU 108 calculates equation (3) of the linear interpolation relationship Aref between the output (amount of irradiating light) of the light-emitting portion and the amount of received light of the light-receiving portion from equation (3) described in the second embodiment.

In S606, the CPU 108 calculates equation (4) of the linear interpolation relationship Bnref between the output (amount of irradiating light) of the light-emitting portion and the amount of received light of the light-receiving portion based on the measurement results Bn−1 and Bn of the correction pattern 804 and the corresponding amounts of light Xn−1 and Xn of the light-emitting portion 7*a*.

In S607, the CPU 108 calculates the amount of light X for obtaining Aref−Bnref=difference in amount of light Cref (predetermined value) based on the calculation result in S606.

In step S608, the CPU 108 obtains the amount of received light Bx of the light-receiving portion 7*b* corresponding to the amount of light X calculated in step S607 based on the linear interpolation relationship Bnref between the output (amount of irradiating light) of the light-emitting portion and the amount of received light of the light-receiving portion for the correction pattern. By adding Cref (predetermined value) to the amount of received light Bx, the CPU 108 calculates Ax (=Cref+Bx) as an amount of reflected light (amount of light of the light-receiving portion) for identifying the intermediate transfer belt 5.

The fourth embodiment can obtain the relationship between the amounts of light of the light-emitting portion and light-receiving portion at high precision by interpolating and using a plurality of measurement results corresponding to changed amounts of light of the light-emitting portion. Hence, the fourth embodiment can reduce correction pattern detection errors.

Further, the fourth embodiment can simplify the process to adjust the timing to individually form a correction pattern and the timing to measure an amount of reflected light by changing the amount of light.

Fifth Embodiment

Figure 11A:
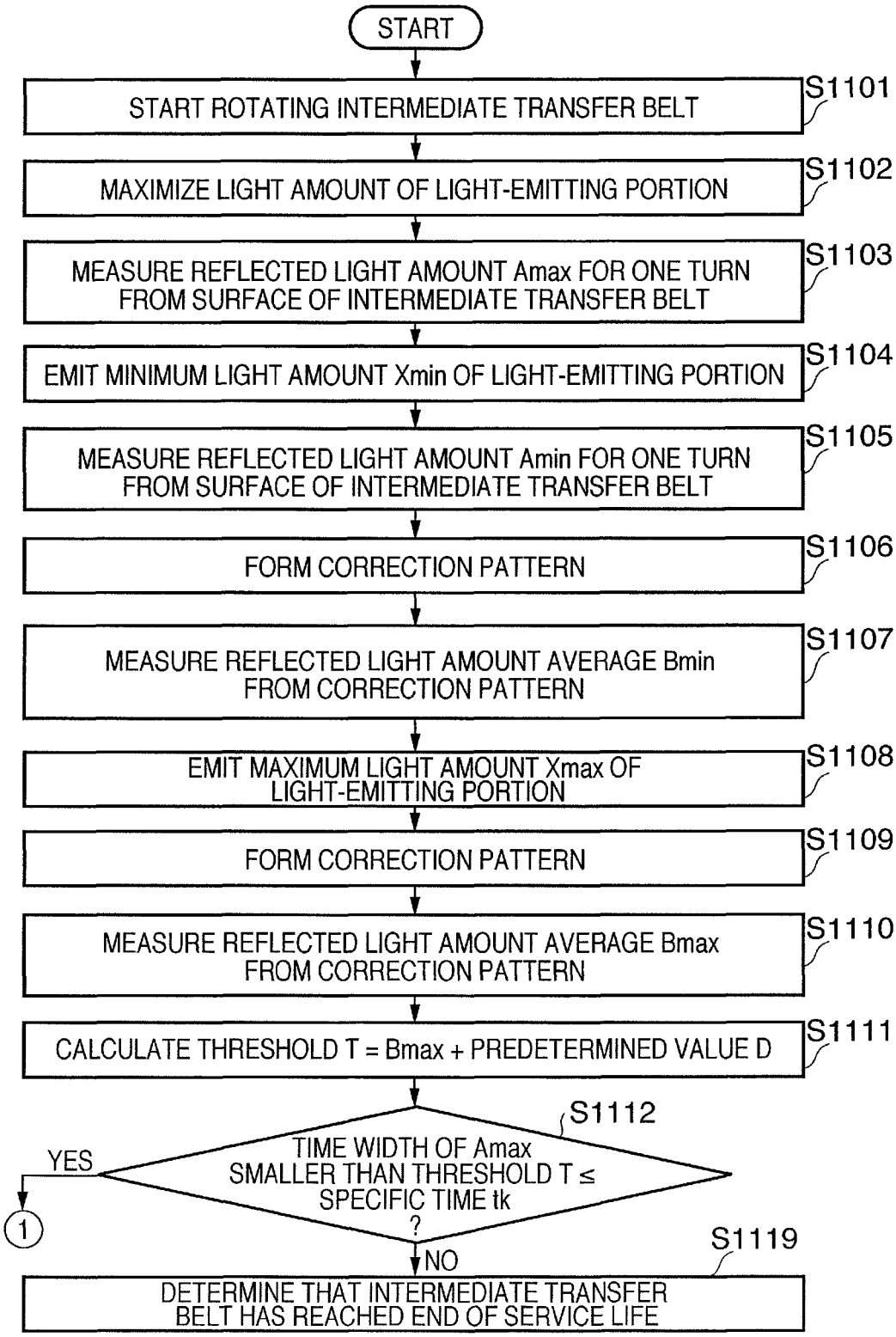
FIGS. 11A and 11B are flowcharts for explaining the sequence of light amount adjustment according to the fifth embodiment.
Figure 11B:
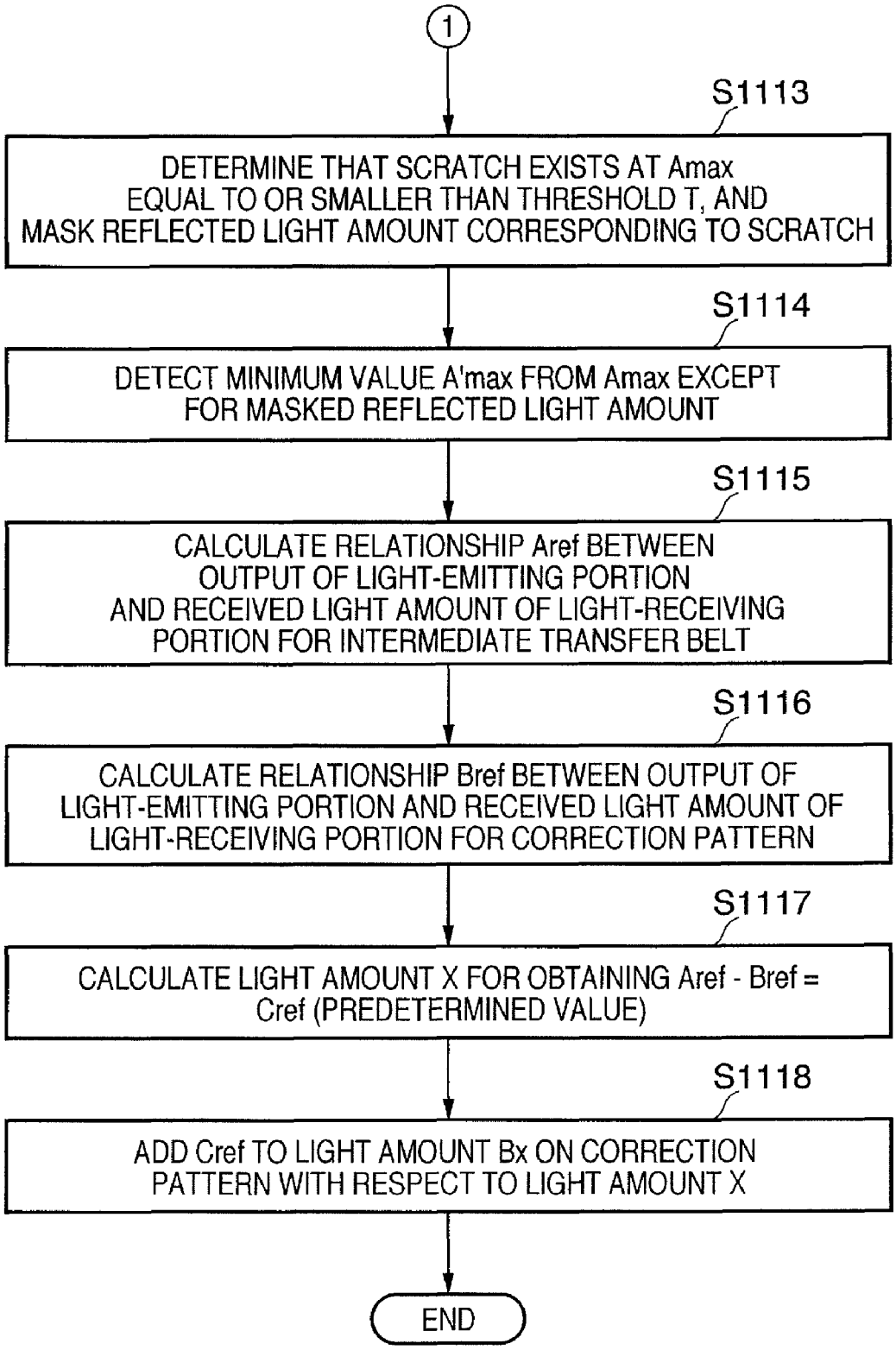

Adjustment of amount of light by an image forming apparatus according to the fifth embodiment will be explained. The presence/absence of a scratch on the surface of an intermediate transfer belt 5 is determined. The amount of irradiating light of a light-emitting portion is adjusted based on the determination result. FIGS. 11A and 11B are flowcharts for explaining the sequence of adjustment of amount of light in the image forming apparatus according to the fifth embodiment. The adjustment of amount of light is executed under the control of a CPU 108.

When the light amount adjustment sequence starts, the CPU 108 rotates the intermediate transfer belt 5 in step S1101.

In step S1102, the CPU 108 controls a correction pattern detection sensor 7, and a light-emitting portion 7*a* emits the maximum amount of irradiating light onto the surface of the intermediate transfer belt 5.

In step S1103, a light-receiving portion 7*b* of the correction pattern detection sensor 7 measures the amount of reflected light Amax from the surface of the intermediate transfer belt 5 for one turn in a predetermined sampling period with respect to the maximum amount of irradiating light emitted in step S1102.

The measured data is stored in, for example, a storage unit 185 which can be formed from a hard disk or the like.

In step S1104, the CPU 108 controls the correction pattern detection sensor 7, and the light-emitting portion 7*a* emits the minimum amount of irradiating light onto the surface of the intermediate transfer belt 5.

In step S1105, the light-receiving portion 7*b* of the correction pattern detection sensor 7 measures the amount of reflected light Amin for one turn from the surface of the intermediate transfer belt 5 in a predetermined sampling period with respect to the minimum amount of irradiating light emitted in step S1104.

By these steps, the measurement results of the amounts of reflected light Amin and Amax from the intermediate transfer belt 5 with respect to minimum and maximum amounts of irradiating light can be obtained. The storage unit 185 stores the measured data.

Then, an amount of reflected light from a correction pattern formed on the intermediate transfer belt 5 is measured. In step S1106, a correction pattern based on image data generated by a pattern generator 105 is formed on the intermediate transfer belt 5.

In step S1107, the CPU 108 controls the correction pattern detection sensor 7, and the light-emitting portion 7*a* emits the minimum amount of irradiating light to the correction pattern formed in step S1106. The light-receiving portion 7*b* receives reflected light from the correction pattern.

The light-emitting portion 7*a* irradiates a correction pattern 901 with the minimum amount of irradiating light at the sampling count Ns every sampling time ts upon the lapse of the light amount stabilization time after the correction pattern reaches the detection position of the correction pattern detection sensor 7 as shown in FIG. 9. The light-receiving portion 7*b* measures amounts of reflected light from the correction pattern 901. The CPU 108 calculates the average as Bmin at the sampling count Ns based on the measurement results of the light-receiving portion 7*b*. The storage unit 185 stores the measured data.

In step S1108, the CPU 108 controls the correction pattern detection sensor 7, and the light-emitting portion 7*a* emits the maximum amount of irradiating light.

In step S1109, a correction pattern based on image data generated by the pattern generator 105 is formed on the intermediate transfer belt 5. The correction pattern formed in step S1106 is also available.

In step S1110, the CPU 108 controls the correction pattern detection sensor 7, and the light-emitting portion 7*a* irradiates the correction pattern formed in step S1109 with the maximum amount of irradiating light. The light-receiving portion 7*b* receives reflected light from the correction pattern.

The light-emitting portion 7*a* irradiates the correction pattern 901 with the maximum amount of irradiating light at the sampling count Ns every sampling time ts upon the lapse of the light amount stabilization time after the correction pattern reaches the detection position of the correction pattern detection sensor 7. The light-receiving portion 7*b* measures amounts of reflected light from the correction pattern 901. The CPU 108 calculates the average as Bmax at the sampling count Ns based on the measurement results of the light-receiving portion 7*b*. The storage unit 185 stores the measured data.

In step S1111, the CPU 108 calculates a light amount threshold T by $$T=B\max+D(\text{predetermined value}) \quad (5)$$

The predetermined value D is arbitrarily settable in accordance with the material of the intermediate transfer belt or the type of toner for use.

In step S1112, the CPU 108 compares the light amount threshold T with Amax measured in step S1103 for one turn of the intermediate transfer belt. The CPU 108 determines whether the time width of Amax which is equal to or smaller than the light amount threshold T is equal to or smaller than a specific time tk.

If the CPU 108 determines that the time width of Amax which is equal to or smaller than the light amount threshold T is larger than the specific time tk (NO in S1112), the process advances to step S1119. The CPU 108 determines that the intermediate transfer belt has reached the end of its service life (the intermediate transfer belt needs to be exchanged).

If the CPU 108 determines in step S1112 that the time width of Amax which is equal to or smaller than the light amount threshold T is equal to or smaller than the specific time tk (YES in S1112), the process advances to step S1113.

In step S1113, the CPU 108 determines that the intermediate transfer belt 5 is scratched at a portion corresponding to the reflected light amount Amax equal to or smaller than the light amount threshold T. The CPU 108 masks an amount of reflected light corresponding to the scratch.

Figure 15:
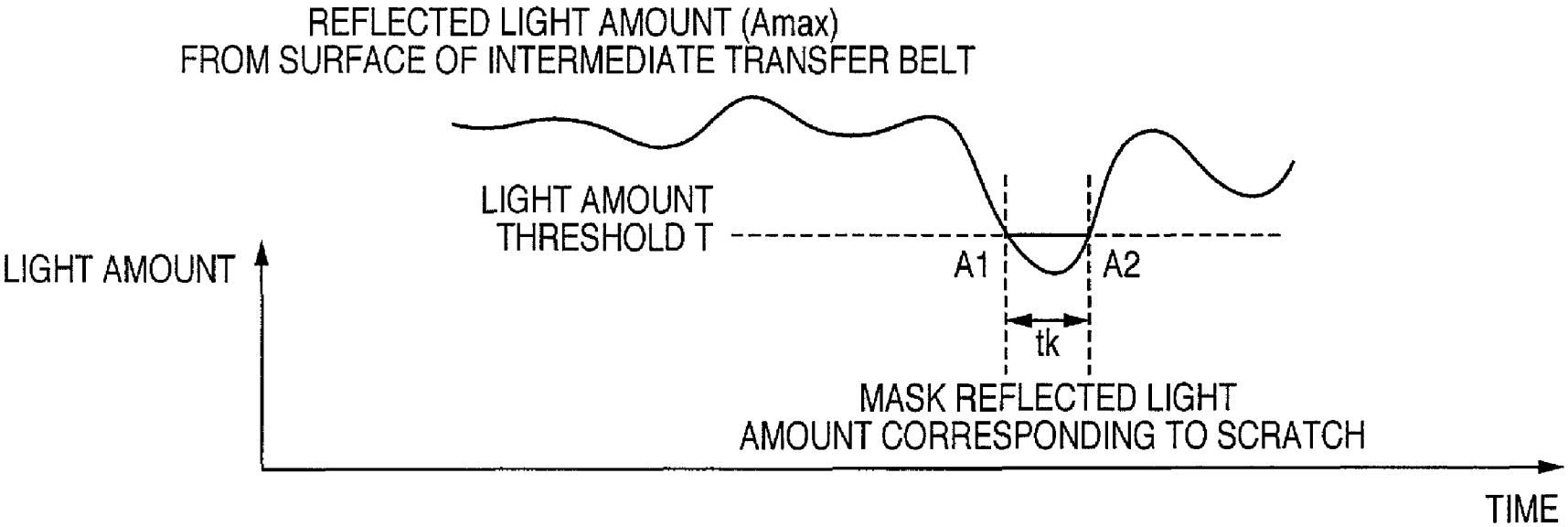
FIG. 15 is a graph illustrating the relationship between the light amount threshold T and the amount of reflected light Amax from the surface of an intermediate transfer belt.

FIG. 15 is a graph illustrating the relationship between the light amount threshold T and the amount of reflected light Amax from the surface of the intermediate transfer belt. When the time width at which Amax is equal to or smaller than the light amount threshold T is equal to or smaller than Tk, the CPU 108 determines that the amount of reflected light Amax decreases owing to variations in surface reflectance caused by the scratch of the intermediate transfer belt 5. Based on the determination result, the CPU 108 corrects (masks), to the light amount threshold T, the amount of reflected light between A1 and A2 that corresponds to the scratch.

In step S1114, the CPU 108 detects a minimum value A'max from the amount of reflected light Amax except for the amount of reflected light masked in step S1113.

In S1115, the CPU 108 calculates equation (6) of the linear interpolation relationship Aref between the output (irradiating light amount) of the light-emitting portion and the amount of received light of the light-receiving portion based on the measurement results Amin and A'max of the intermediate transfer belt 5 and the maximum amount of light Xmax and minimum amount of light Xmin of the light-emitting portion 7*a:*

$$A\text{ref}=(A'\max-A\min)/(X\max-X\min) \quad (6)$$

In S1116, the CPU 108 calculates equation (7) of the linear interpolation relationship Bref between the output (amount of irradiating light) of the light-emitting portion and the amount of received light of the light-receiving portion based on the measurement results Bmin and Bmax of the correction pattern and the maximum amount of light Xmax and minimum amount of light Xmin of the light-emitting portion 7*a:*

$$B\text{ref}=(B\max-B\min)/(X\max-X\min) \quad (7)$$

The CPU 108 can obtain linear interpolation relationships shown in FIG. 7 between the output (amount of irradiating light) of the light-emitting portion and the amount of received light of the light-receiving portion based on the measurement results Amin and A'max of the intermediate transfer belt 5 and the measurement results Bmin and Bmax of the correction pattern. The storage unit 185 stores the linear interpolation relationships.

In step S1117, the CPU 108 calculates the amount of light X for obtaining Aref−Bref=difference in amount of light Cref (predetermined value). The difference in amount of light Cref (predetermined value) is arbitrarily settable in accordance with the material of the intermediate transfer belt or the type of toner for use. The difference in amount of light Cref (predetermined value) can be set individually. Alternatively, the intermediate value between Aref and Bref is available as Cref based on the calculation results of equations (6) and (7).

In step S1118, the CPU 108 obtains the amount of received light Bx of the light-receiving portion 7*b* corresponding to the amount of light X calculated in step S1117 based on the linear interpolation relationship Bref (FIG. 7) between the output (amount of irradiating light) of the light-emitting portion and the amount of received light of the light-receiving portion for the correction pattern. By adding Cref (predetermined value) to the amount of received light Bx, the CPU 108 calculates Ax (=Cref+Bx) as an amount of reflected light (amount of light of the light-receiving portion) for identifying the intermediate transfer belt 5.

The fifth embodiment determines whether the intermediate transfer belt is scratched. Even if the intermediate transfer belt is scratched, the fifth embodiment can set a minimum light amount value for stably detecting a correction pattern regardless of variations in reflectance.

A correction pattern can be stably detected by setting a minimum light amount value while ensuring a predetermined difference in amount of light between an amount of reflected light from the intermediate transfer belt and that from the correction pattern in order to detect the correction pattern. In other words, even if the toner density of a correction pattern or the reflectance of the transfer belt surface changes, the correction pattern can be stably detected.

The fifth embodiment can prolong the service life of the light-emitting portion of the correction pattern detection sensor by setting a minimum light amount value while ensuring a predetermined difference in amount of light between an amount of reflected light from the intermediate transfer belt and that from a correction pattern.

Sixth Embodiment

Figure 12A:
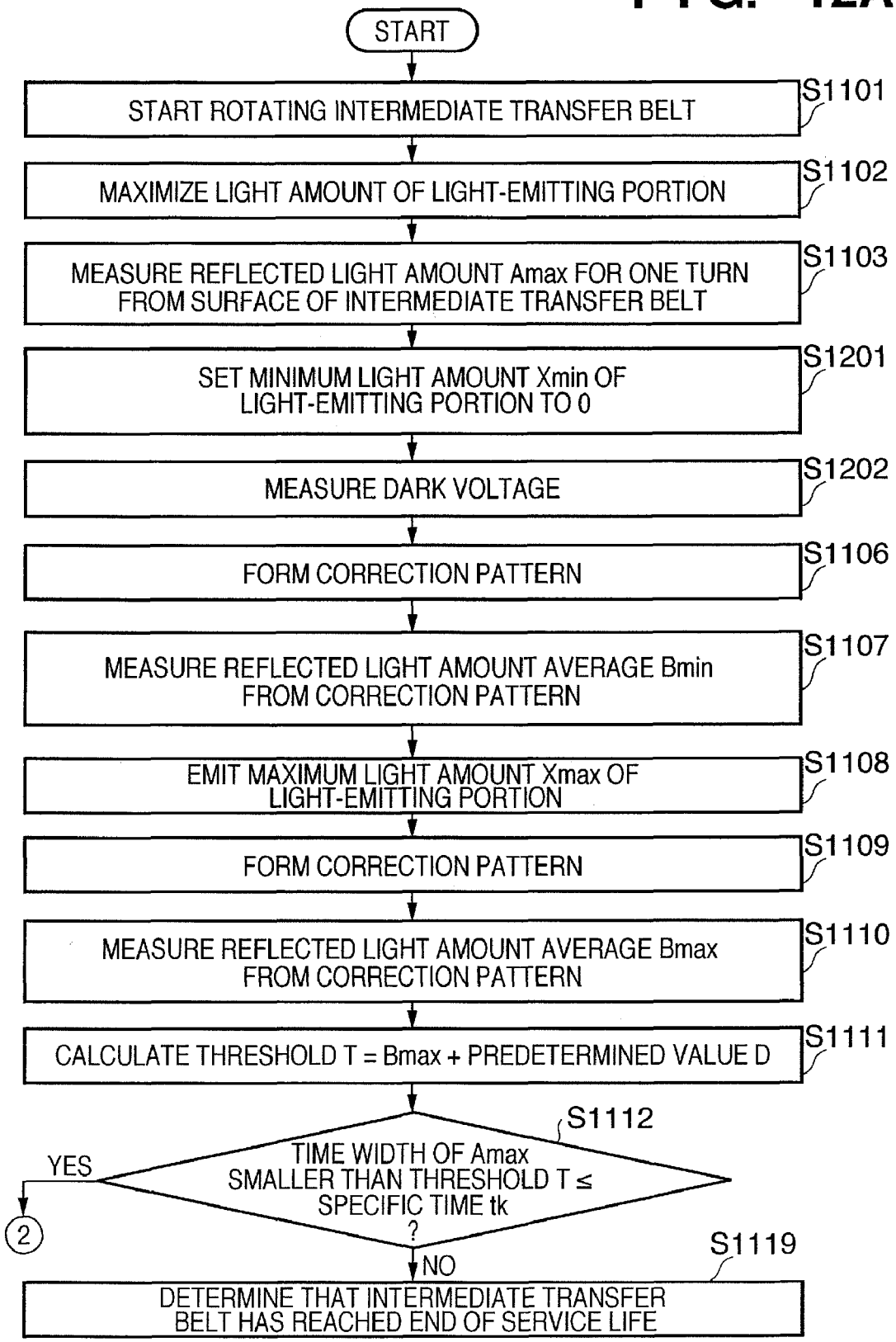
FIGS. 12A and 12B are flowcharts for explaining the sequence of light amount adjustment according to the sixth embodiment.
Figure 12B:
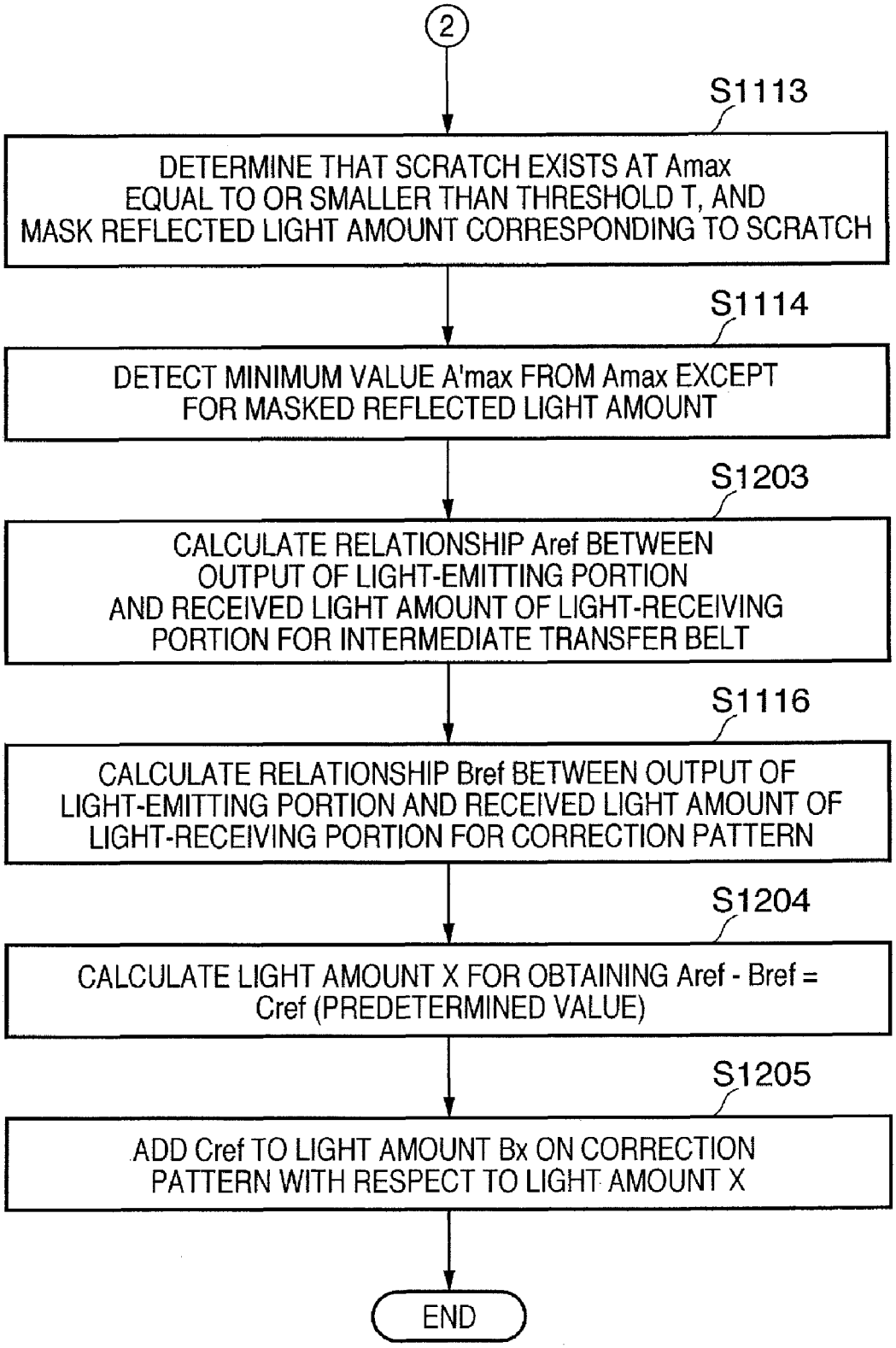

Adjustment of amount of light by an image forming apparatus according to the sixth embodiment will be explained. FIGS. 12A and 12B are flowcharts for explaining the sequence of adjustment of amount of light in the image forming apparatus according to the sixth embodiment. The adjustment of amount of light is executed under the control of a CPU 108. The same step numbers as those in the adjustment of amount of light (FIGS. 11A and 11B) according to the fifth embodiment denote the same processes, and a description thereof will not be repeated. Steps S1101 to S1103 and S1106 to S1110 are the same processes as those in the adjustment of amount of light according to the fifth embodiment.

In step S1201, the CPU 108 controls a correction pattern detection sensor 7 to set the light amount value of a light-emitting portion 7*a* to 0.

In step S1202, the CPU 108 measures the dark voltage of a light-receiving portion 7*b* of the correction pattern detection sensor 7. The CPU 108 outputs the measurement result as an amount of reflected light from the surface of an intermediate transfer belt 5 with respect to the minimum amount of irradiating light. The amount of reflected light from the surface of the intermediate transfer belt 5 becomes 0, or the dark voltage becomes almost constant. An output from the light-receiving portion 7*b* when the light-emitting portion 7*a* is OFF is set, and this value is defined as Amin.

Steps S1111 to S1114 and S1119 are the same processes as those in the fifth embodiment.

In S1203, the CPU 108 calculates equation (8) of the linear interpolation relationship between the output (amount of irradiating light) of the light-emitting portion and the amount of received light of the light-receiving portion based on the measurement result A'max of the intermediate transfer belt 5, the set value Amin, the maximum amount of light Xmax of the light-emitting portion 7*a*, and the minimum amount of light Xmin=0:

$$Aref=(A'max-Amin)/(Xmax) \quad (8)$$

Calculation of Bref in step S1116 is the same as the light amount adjustment process (FIGS. 11A and 11B) using equation (7) in the fifth embodiment.

In S1204, the CPU 108 calculates the amount of light X for obtaining Aref−Bref=difference in amount of light Cref (predetermined value). The difference in amount of light Cref (predetermined value) is arbitrarily settable in accordance with the material of the intermediate transfer belt or the type of toner for use. The difference in amount of light Cref (predetermined value) can be set individually. Alternatively, the intermediate value between Aref and Bref is available as Cref based on the calculation results of equations (7) and (8).

In step S1205, the CPU 108 obtains the amount of received light Bx of the light-receiving portion 7*b* corresponding to the amount of light X calculated in step S1204 based on the linear interpolation relationship Bref between the output (amount of irradiating light) of the light-emitting portion and the amount of received light of the light-receiving portion for the correction pattern. By adding Cref (predetermined value) to the amount of received light Bx, the CPU 108 calculates Ax (=Cref+Bx) as an amount of reflected light (amount of light of the light-receiving portion) for identifying the intermediate transfer belt 5.

The sixth embodiment can shorten the light amount adjustment time by using the dark voltage measurement result without measuring the amount of reflected light Amin from the surface of the intermediate transfer belt 5 in the light amount adjustment process.

Seventh Embodiment

Figure 13A:
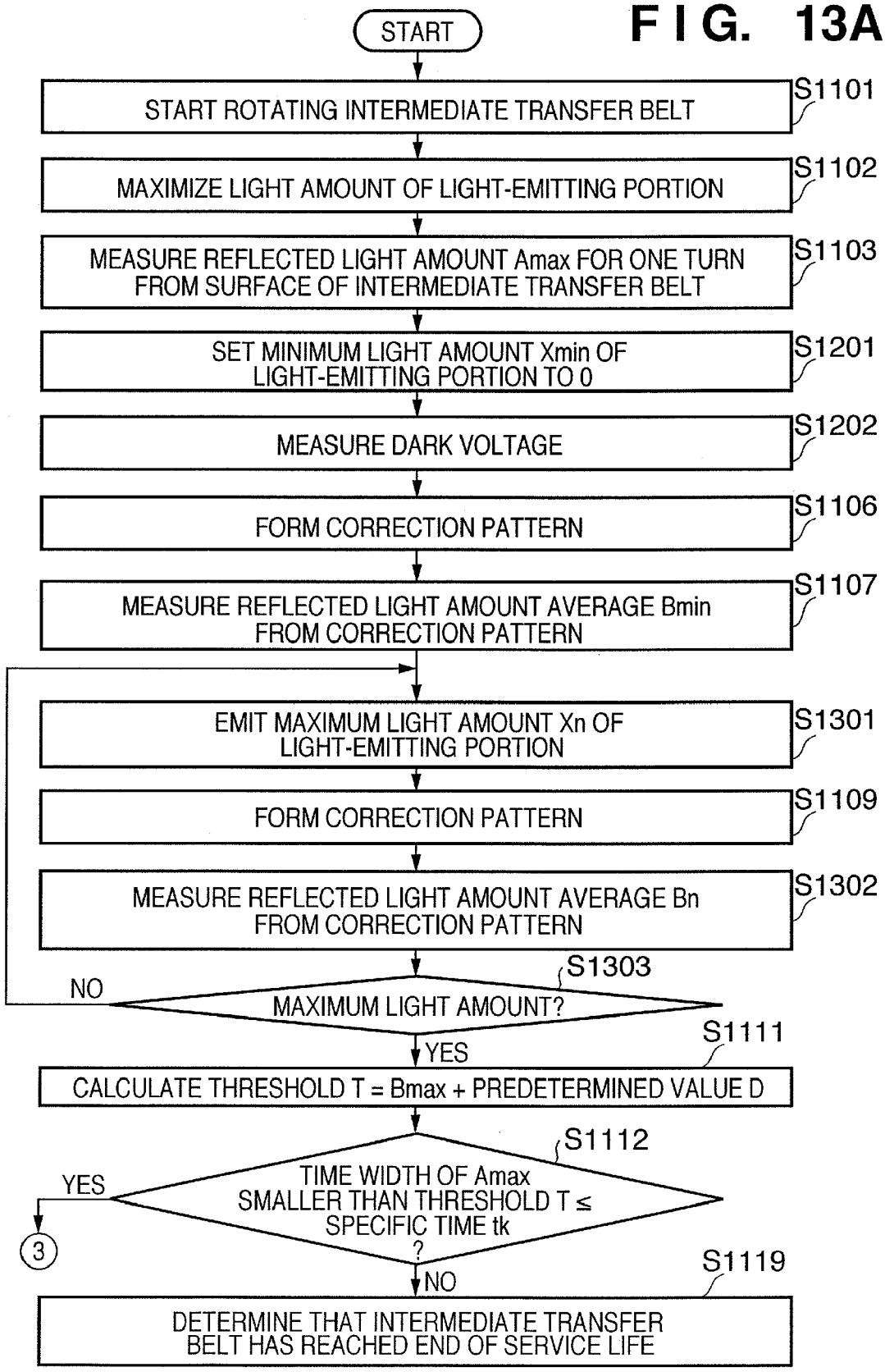
FIGS. 13A and 13B are flowcharts for explaining the sequence of light amount adjustment according to the seventh embodiment.
Figure 13B:
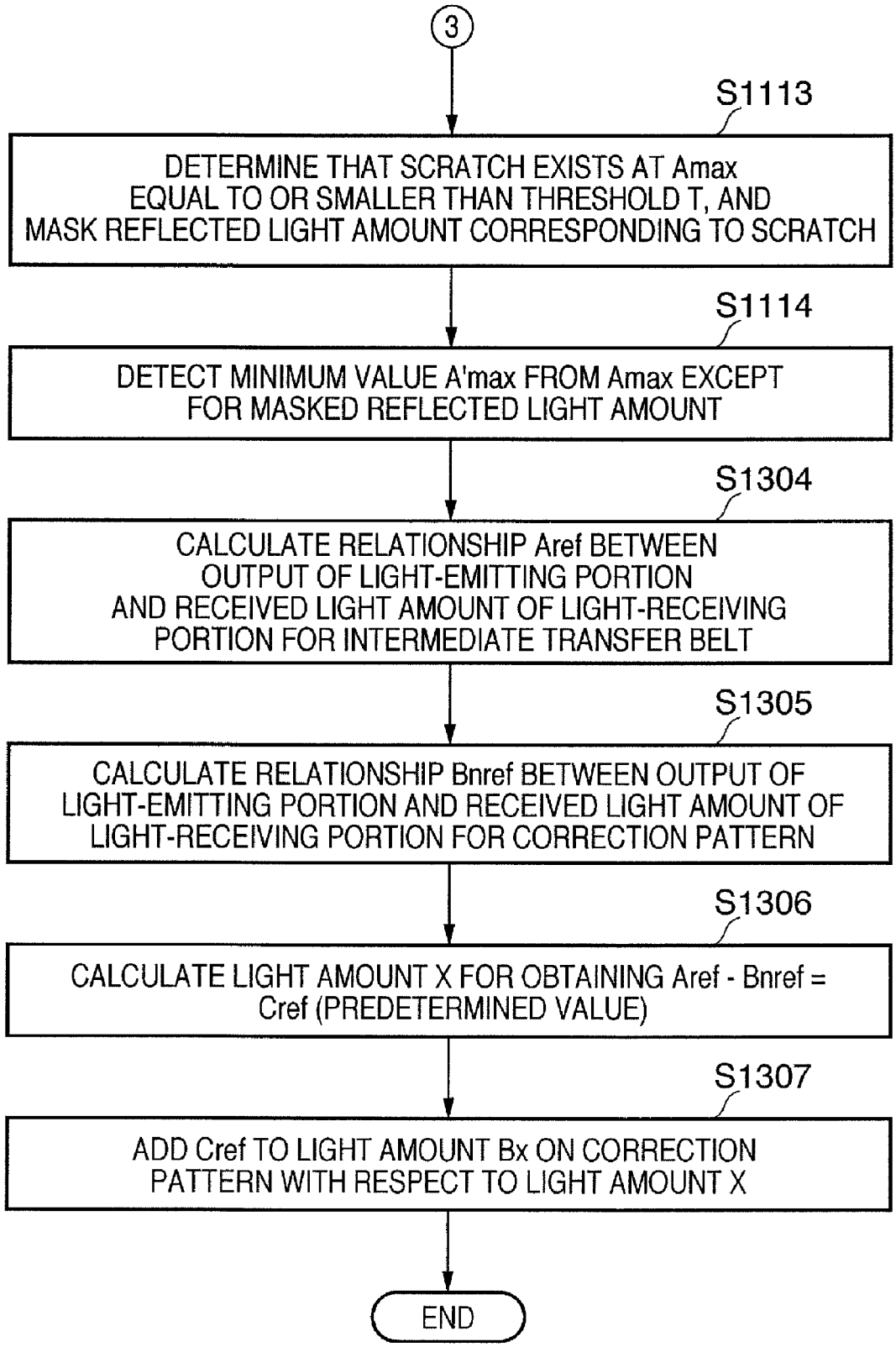

Adjustment of amount of light by an image forming apparatus according to the seventh embodiment will be explained. FIGS. 13A and 13B are flowcharts for explaining the sequence of adjustment of amount of light in the image forming apparatus according to the seventh embodiment. The adjustment of amount of light is executed under the control of a CPU 108. The same step numbers as those in the adjustments of amount of light (FIGS. 11A, 11B, 12A, and 12B) according to the fifth and sixth embodiments denote the same processes, and a description thereof will not be repeated.

Steps S1101 to S1103, S1106, and S1107 are the same processes as those in the adjustment of amount of light according to the fifth embodiment. S1201 and S1202 are the same processes as those in the adjustment of amount of light according to the sixth embodiment.

In step S1301, the CPU 108 controls a correction pattern detection sensor 7, and a light-emitting portion 7*a* changes the irradiating amount of light.

In step S1109, a correction pattern is formed similarly to the process in the fifth embodiment. A correction pattern based on image data generated by a pattern generator 105 is formed on an intermediate transfer belt 5.

In step S1302, the light-emitting portion 7*a* irradiates the correction pattern formed in step S1109 with the amount of irradiating light changed in step S1301. The correction pattern irradiation timing and the amount of light have the relationship shown in FIG. 8A.

In step S1303, the CPU 108 determines whether the amount of light of the light-emitting portion 7*a* has reached a maximum. If the amount of light of the light-emitting portion 7*a* has not reached the maximum one (NO in S1303), the process returns to step S1301 to repeat the same processes for correction patterns 802 and 803 (FIG. 8A). As shown in FIG. 8A, the amount of light of the light-emitting portion 7*a* is increased sequentially to light amount 1 . . . <light amount 3 . . . <maximum light amount Nmax. The light-receiving portion 7*b* measures an amount of reflected light average Bn corresponding to each amount of light. A storage unit 185 stores the measured data.

If the CPU 108 determines in step S1303 that the amount of light of the light-emitting portion 7*a* has reached a maximum (YES in S1303), the process advances to step S1111.

At this stage, measurement of the average amount of reflected light Bn (n=1 (light amount 1), 2 (light amount 2), 3 (light amount 3), . . . , N (maximum light amount)) corresponding to each amount of light is completed.

Processes in steps S1111 to S1114 and S1119 are the same as those in the adjustment of amount of light according to the fifth embodiment.

In S1304, the CPU 108 calculates the linear interpolation relationship Aref between the output (amount of irradiating light) of the light-emitting portion and the amount of received light of the light-receiving portion based on the measurement result A'max of the intermediate transfer belt 5, the set value Amin, the maximum amount of light Xmax of the light-emitting portion 7*a*, and the minimum amount of light Xmin=0. Aref can be calculated from equation (8) in the sixth embodiment.

In step S1305, the CPU 108 calculates the linear interpolation relationship Bnref between the output (amount of irradiating light) of the light-emitting portion and the amount of received light of the light-receiving portion based on the measurement results Bn−1 and Bn of the correction pattern and the amounts of corresponding light Xn−1 and Xn of the light-emitting portion 7*a*. Bnref can be calculated from equation (4) described in the third embodiment.

In step S1306, the CPU 108 calculates the amount of X for obtaining Aref−Bnref=difference in amount of light Cref (predetermined value) based on the calculation results in S1304 and S1305.

In step S1307, the CPU 108 obtains the amount of received light Bx of the light-receiving portion 7*b* corresponding to the amount of light X calculated in step S1306 based on the linear interpolation relationship Bnref between the output (amount of irradiating light) of the light-emitting portion and the amount of received light of the light-receiving portion for the correction pattern. By adding Cref (predetermined value) to the amount of received light Bx, the CPU 108 calculates Ax (=Cref+Bx) as an amount of reflected light (amount of light of the light-receiving portion) for identifying the intermediate transfer belt 5.

The seventh embodiment can attain the relationship between the amounts of light of the light-emitting portion and light-receiving portion at high precision by interpolating and using a plurality of measurement results corresponding to changed amounts of light of the light-emitting portion. The seventh embodiment can reduce correction pattern detection errors.

Eighth Embodiment

Figure 14A:
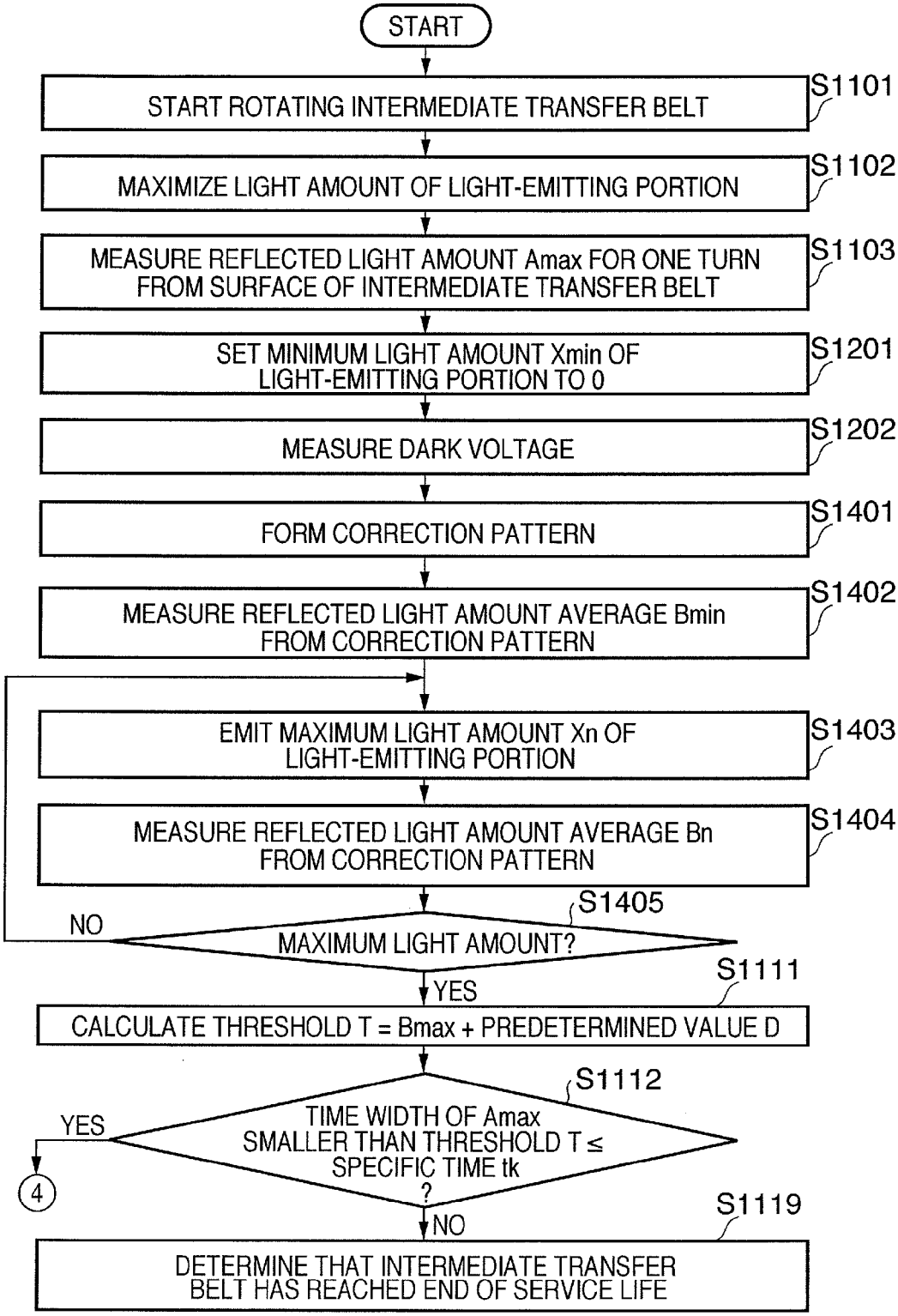
FIGS. 14A and 14B are flowcharts for explaining the sequence of light amount adjustment according to the eighth embodiment.
Figure 14B:
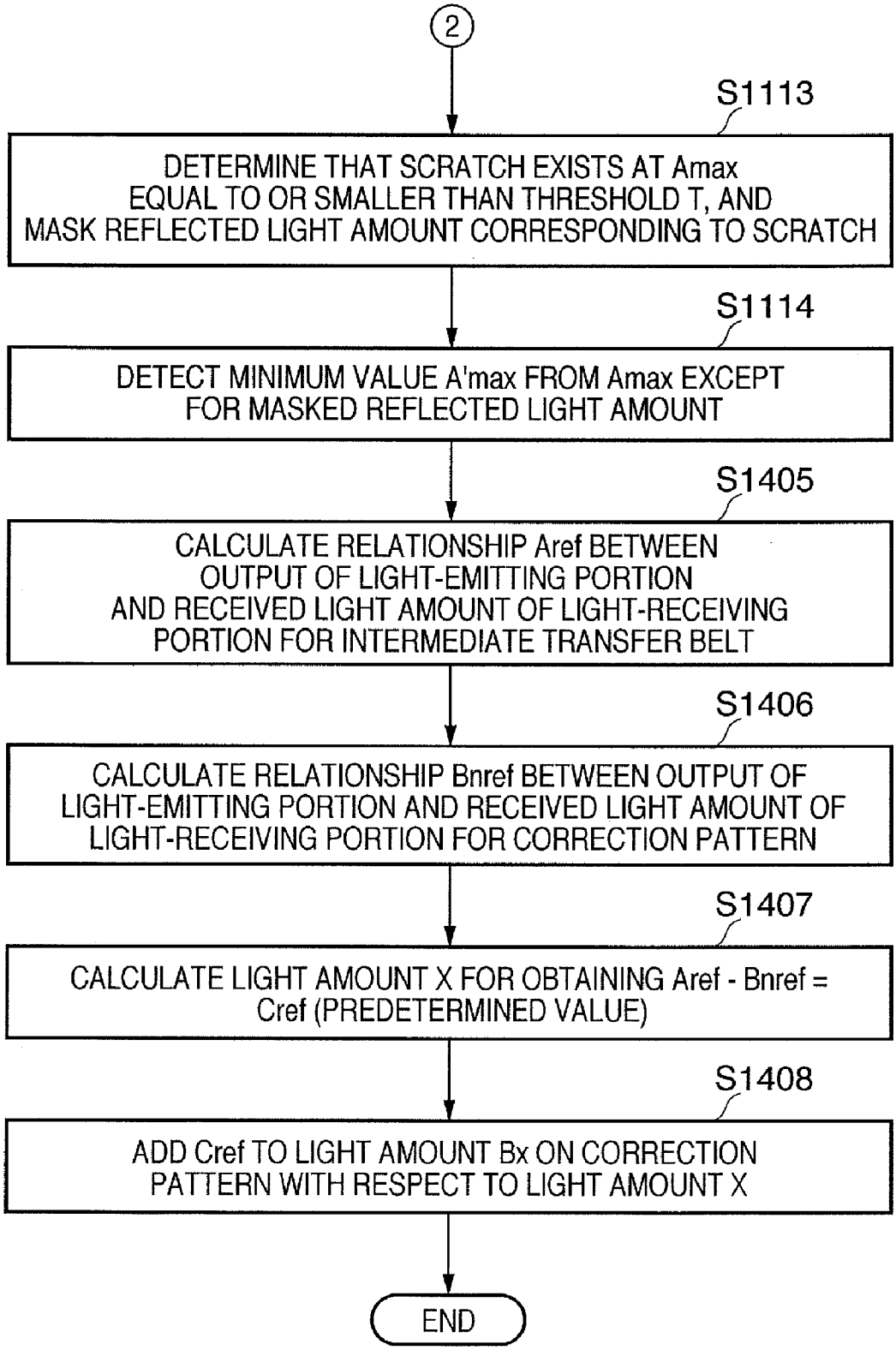

Adjustment of amount of light by an image forming apparatus according to the eighth embodiment will be explained. FIGS. 14A and 14B are flowcharts for explaining the sequence of adjustment of amount of light in the image forming apparatus according to the eighth embodiment. The adjustment of amount of light is executed under the control of a CPU 108. The same step numbers as those in the adjustments of amount of light (FIGS. 11A, 11B, 12A, and 12B) according to the fifth to seventh embodiments denote the same processes, and a description thereof will not be repeated.

Steps S1101 to S1103 are the same processes as those in the adjustment of amount of light according to the fifth embodiment. S1201 and S1202 are the same processes as those in the adjustment of amount of light according to the sixth embodiment.

In step S1401, a correction pattern 804 (FIG. 8B) based on image data generated by a pattern generator 105 is formed on an intermediate transfer belt 5.

In step S1402, the CPU 108 controls a correction pattern detection sensor 7, and a light-emitting portion 7*a* irradiates the correction pattern 804 formed in step S1401 with irradiating light of light amount 1 (FIG. 8B). A light-receiving portion 7*b* receives reflected light from the correction pattern, and the average of measurement results is defined as Bmin.

In step S1403, the CPU 108 controls the correction pattern detection sensor 7 to increase the amount of irradiating light of the light-emitting portion 7*a* by a predetermined value (for example, the amount of irradiating light increases to light amount 2 in FIG. 8B).

In step S1404, the light-emitting portion 7*a* irradiates the correction pattern 804 with the changed amount of irradiating light at the sampling count Ns every sampling time ts upon the lapse of the light amount stabilization time (FIG. 8B). The light-receiving portion 7*b* measures amounts of reflected light from the correction pattern 804. The CPU 108 calculates the average as Bn at the sampling count Ns based on the measurement results of the light-receiving portion 7*b*.

In step S1405, the CPU 108 determines whether the amount of light of the light-emitting portion 7*a* has reached a maximum. If the amount of light of the light-emitting portion 7*a* has not reached a maximum (NO in S1405), the process returns to step S1403 to repeat the same processes. As shown in FIG. 8B, the amount of light of the light-emitting portion 7*a* is increased to light amount 3 and light amount 4. The light-receiving portion 7*b* measures Bn corresponding to each amount of light until the amount of light amount reaches a maximum (light amount 4 in FIG. 8B).

If the CPU 108 determines in step S1405 that the amount of light of the light-emitting portion 7*a* has reached a maximum (YES in S1405), the process advances to step S1111.

At this stage, measurement of Bn (n=1 (light amount 1), 2 (light amount 2), 3 (light amount 3), and 4 (light amount 4: maximum light amount)) corresponding to each amount of light is completed. A storage unit 185 stores the measured data.

Processes in steps S1111 to S1114 and S1119 are the same as those in the adjustment of amount of light according to the fifth embodiment.

In step S1405, the CPU 108 calculates the linear interpolation relationship Aref between the output (amount of irradiating light) of the light-emitting portion and the amount of received light of the light-receiving portion based on the measurement result A'max of the intermediate transfer belt 5, the set value Amin, the maximum amount of light Xmax of the light-emitting portion 7*a*, and the minimum amount of light Xmin=0. Aref can be calculated from equation (8) in the sixth embodiment.

In step S1406, the CPU 108 calculates the linear interpolation relationship Bnref between the output (amount of irradiating light) of the light-emitting portion and the amount of received light of the light-receiving portion based on the measurement results Bn−1 and Bn of the correction pattern and the corresponding amounts of light Xn−1 and Xn of the light-emitting portion 7*a*. Bnref can be calculated from equation (4) described in the third embodiment.

In step S1407, the CPU 108 calculates the amount of light X for obtaining Aref−Bnref=difference in amount of light Cref (predetermined value) based on the calculation results in S1405 and S1406.

In step S1408, the CPU 108 obtains the amount of received light Bx of the light-receiving portion 7*b* corresponding to the amount of light X calculated in step S1407 based on the linear interpolation relationship Bnref between the output (amount of irradiating light) of the light-emitting portion and the amount of received light of the light-receiving portion for the correction pattern. By adding Cref (predetermined value) to the amount of received light Bx, the CPU 108 calculates Ax (=Cref+Bx) as an amount of reflected light (amount of light of the light-receiving portion) for identifying the intermediate transfer belt 5.

The eighth embodiment can obtain the relationship between the amounts of light of the light-emitting portion and light-receiving portion with high precision by interpolating and using a plurality of measurement results corresponding to changed amounts of light of the light-emitting portion. The eighth embodiment can, therefore, reduce correction pattern detection errors.

In addition, the eighth embodiment can simplify the process to adjust the timing to individually form a correction pattern and the timing to measure an amount of reflected light by changing the amount of light.

Other Embodiments

The object of the present invention is also achieved by supplying a storage medium which stores software program codes for implementing the functions of the above-described embodiments to a system or apparatus. The object of the present invention is also achieved by reading out and executing the program codes stored in the storage medium by the computer (or the CPU or MPU) of the system or apparatus.

In this case, the program codes read out from the storage medium implement the functions of the above-described embodiments, and the storage medium which stores the program codes constitutes the present invention.

The storage medium for supplying the program codes includes a flexible disk, hard disk, optical disk, magnetooptical disk, CD-ROM, CD-R, nonvolatile memory card, and ROM.

The functions of the above-described embodiments are implemented when the computer executes the readout program codes. Also, the present invention includes a case where an OS (Operating System) or the like running on the computer performs some or all of actual processes based on the instructions of the program codes and thereby implements the functions of the above-described embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-279155, filed Oct. 12, 2006, which is hereby incorporated by reference herein in its entirety.

What is claimed is:

1. An image forming apparatus which forms image on a print medium by using a plurality of color toners, said image forming apparatus comprising:

a plurality of image carriers;

a plurality of image forming units adapted to form toner images by using a color toner corresponding to each of the plurality of image carriers;

an intermediate transfer member adapted to transfer the toner images formed on the plurality of image carriers;

a pattern formation unit adapted to control the plurality of image forming units so that correction patterns for correcting a registration error amount between the toner images are formed on the intermediate transfer member, wherein each of the correction patterns is formed by each of the plurality of color toners, and each of the correction patterns is formed at a different position on the intermediate transfer member;

a detection unit adapted to include a light-emitting portion for emitting light to the intermediate transfer member and a light-receiving portion for receiving the light reflected from the intermediate transfer member;

a control unit adapted to calculate a registration error amount between the correction patterns based on a difference between amount of light reflected from the intermediate transfer member and amount of light reflected from the correction patterns, and to control a position at which each of the toner images is formed based on the calculated registration error amount;

a light amount control unit adapted to control amount of light emitted by the light-emitting portion, wherein the light amount control unit controls the amount of the light so that a difference between the amount of the light reflected from the intermediate transfer member and amount of light reflected from at least one of the correction patterns equals to a predetermined value;

wherein the light amount control unit controls the amount of the light so that the correction patterns are irradiated by a first light amount, and the intermediate transfer member is irradiated by a second light amount which is greater than the first light amount, wherein the light amount control unit includes a calculation unit adapted to calculate:

a first linear interpolation relationship obtained by performing linear interpolations of (i) a correspondence between the first light amount and amount of light reflected from the intermediate transfer member, in a case where the amount of the light emitted from the light-emitting portion is the first light amount, and (ii) a correspondence between the second light amount and amount of light reflected from the intermediate transfer member, in a case where the amount of the light emitted from the light-emitting portion is the second light amount, and a second linear interpolation relationship obtained by performing linear interpolations of (i) a correspondence between the first light amount and amount of light reflected from the correction patterns, in a case where the amount of the light emitted from the light-emitting portion is the first light amount, and (ii) a correspondence between the second light amount and amount of light reflected from the correction patterns, in a case where the amount of the light emitted from the light-emitting portion is the second light amount, and wherein the light amount control unit controls the amount of the light emitted from the light-emitting portion so that a difference between the amount of the light reflected from intermediate transfer member and the amount of the light reflected from the correction patterns equals to the predetermined value based on the first linear interpolation relationship and the second linear interpolation relationship.

2. The image forming apparatus according to claim 1, wherein the light amount control unit controls the light-emitting portion included in the detection unit so that maximum amount of light as the second light amount is emitted from the light-emitting portion.

3. The image forming apparatus according to claim 1, further comprising:

a memory unit adapted to store the predetermined value; and an input unit adapted to input, in order to change the predetermined value stored in the memory unit, a second predetermined value which differs from the predetermined value.

* * * * *